US006806012B2

(12) United States Patent
Yamauchi et al.

(10) Patent No.: US 6,806,012 B2
(45) Date of Patent: Oct. 19, 2004

(54) ELECTROSTATIC IMAGE DEVELOPING

(75) Inventors: Yasuko Yamauchi, Hachioji (JP); Ken Ohmura, Hachioji (JP); Masafumi Uchida, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/244,856

(22) Filed: Sep. 16, 2002

(65) Prior Publication Data

US 2003/0091920 A1 May 15, 2003

(30) Foreign Application Priority Data

Sep. 19, 2001 (JP) ..... 2001/284831

(51) Int. Cl.[7] ..... G03G 9/093

(52) U.S. Cl. ..... 430/110.3; 430/110.4; 430/125; 430/137.14

(58) Field of Search ..... 430/110.3, 110.4, 430/125, 137.14, 110.1

(56) References Cited

U.S. PATENT DOCUMENTS 6,337,169 B1 * 1/2002 Hashimoto et al. ..... 430/126
6,365,312 B1 * 4/2002 Foucher et al. ..... 430/108.21
6,432,590 B1 * 8/2002 Ueda et al. ..... 430/110.3
6,615,015 B2 * 9/2003 Nakazawa et al. ..... 428/141

FOREIGN PATENT DOCUMENTS

JP 2000 214629 8/2000

* cited by examiner

*Primary Examiner*—John L Goodrow

(57) ABSTRACT

An electrostatic image developing toner is disclosed. The resin of the toner particle has a cell structure and an average value of FERE-horizontal diameters of the cells is from 20 to 200 nm and a variation coefficient of the FERE-horizontal diameters of the cells is from 10 to 35%.

21 Claims, 7 Drawing Sheets

TONER HAVING NO CORNERS

TONER HAVING CORNERS

TONER HAVING CORNERS

ELECTROSTATIC IMAGE DEVELOPING

FIELD OF THE INVENTION

This invention relates to a toner for developing a static charged image to be used for a copying machine or a printer, a production method of the toner, an image forming method and an image forming apparatus using the toner.

BACKGROUND OF THE INVENTION

Japanese Patent Publication Open to Public Inspection No. 2000-214629 discloses that a polymerized toner prepared by a suspension polymerization method or an emulsion polymerization method has particles each having a small diameter with a narrow diameter frequency and a shape of rounded corner since the diameter and the shape of the toner particles can be controlled in an aqueous medium in which the polymerization is performed. Such the toner is noted as a toner capable of reproducing a small dot of a digital image in accordance with high fine line reproducibility and high image resolving ability hereof.

The polymerized toner is required to have ability for suiting the recycling use since a technology of recycling use of the toner is applied also on such the toner. A problem is on such the toner, however, that the toner is deteriorated and finely powdered when the toner is subjected to mechanical shearing stress in the course of stirring in a developing device or conveying in a recycle means. Particularly in an image forming apparatus having the tone recycling means, the toner is placed in an environment in which the deterioration and formation of the fine powder of the toner tends to be accelerated since the tone is frequently subjected to the shearing stress in a long period.

The deterioration and the finely powdering of the toner is further made worse by formation of cracks on the surface of the toner particle caused by the action of ozone which decomposes organic substances since ozone formed at the time of light exposing for image formation exists in the image forming apparatus. Consequently, a countermeasure such that to inhibit the formation of ozone caused by the light exposure or that to provide a function of effectively exhaust ozone to the image forming apparatus is taken. However, the problems of the deterioration and the powdering of the toner are not sufficiently solved yet.

The fine powdered particle of the toner formed by the mechanical shearing stress in the developing device or the toner recycling means is easily scattered. Accordingly, the fine powder of the toner causes the contamination the triboelectric charging device or the photoreceptor and a problem of insufficient cleaning since the finely powdered toner particle is easily passed through the cleaning device. Moreover, the finely powdered toner is adhered on an image receiving medium such as a recording paper, and causes fogging at the non-imaged white background of the image. The finely powdered toner adhered and remained on the transfer electrode causes insufficient transfer, and a result of that, problems such as occurrence of contamination on the halftone image caused by the insufficient transfer, formation of contamination of the white background of the image receiving paper by the finely powdered toner passed trough the cleaning device, and formation of line shaped contamination on the halftone image by adhering of the finely powdered toner remained on the developing roller accompanied with the repeating of the image formation. Furthermore, an insufficient fixation is induced since the fixing ability of the fixing device is lowered by the accumulation of the scattered finely powdered toner in the fixing device. Such the problem is made serious when the image forming apparatus is used under a condition with a low temperature and a low humidity.

SUMMARY OF THE INVENTION

The invention is attained on the above-described background.

The first object of the invention is to provide a toner for developing a static charged image having sufficient ozone resistively, which is not deteriorated and not powdered in an atmosphere forming ozone.

The second object of the invention is to provide a toner for developing a static charged image usable in an image forming apparatus having atoner recycle means.

The third object of the invention is to provide a toner for developing a static charged image by which a clean electrophotographic image without formation of fogging on the white background and that of line-shape contamination or unevenness of the density in the halftone image.

The fourth object of the invention is to provide a toner for developing a static charged image excellent in the fixing ability, by which no insufficient fixation is occurred even when the image formation is carried out under a low temperature and low humidity condition.

The fifth object of the invention is to provide a toner for developing a static charged image by which a character image without spreading and a high quality image excellent in the fine line reproducibility can be stably obtained in a prolonged period.

And another object of the invention is to provide a toner for developing a static charged image wherein the toner particle itself has a high resistivity against ozone.

In the invention, it has been found that a toner particle in which the resin constituting the toner particle has a cell structure has a high durability and such the toner particle is not deteriorated and not powdered even when the toner particle is stirred in a prolonged period for image formation under a condition with the presence of a high concentration of ozone such as that in the developing device of the image forming apparatus.

The summary and preferable embodiments of the invention are described below.

A toner for developing a static charged image containing a toner particle at least comprising a resin and a colorant, wherein the resin constituting the toner particle has a cell structure having cells and a cell wall, and an average value of the FERE-horizontal diameters of the cells is from 20 to 200 nm and a variation coefficient of the FERE-horizontal diameters of the cells is from 10 to 35%.

The average value of the FERE-horizontal diameters is from 120 to 160 nm and the variation coefficient is preferably not more than 30%.

The toner particle preferably further contains a crystalline substance.

It is preferable that the colorant particles are distributed between the cells.

It is preferable in the toner particle containing the resin, the colorant and the crystalline substance that the colorant particles are distributed between the cells.

It is preferable in the toner particle containing the resin, the colorant and the crystalline substance that the crystalline substance is distributed between the cells.

It is preferable the number variation coefficient in the number size distribution is not more than 27 percent and the variation coefficient of said shape coefficient is not more than 16 percent.

It is preferable the ratio of toner particles without corners is at least 50 percent by number and the number variation coefficient in the number particle size distribution is 27 percent or less.

It is preferable that a number ratio of toner particles having a shape coefficient of 1.2 to 1.6 and is at least 65 percent, and further the variation coefficient of said shape coefficient is not more than 16 percent, and the number variation coefficient in the number particle size distribution is 27 percent or less.

The toner of the present invention preferably has a sum M of at least 70 percent. Said sum M is obtained by adding relative frequency m1 of toner particles, included in the most frequent class, to relative frequency m2 of toner particles included in the second frequent class in a histogram showing the particle diameter distribution, which is drawn in such a manner that natural logarithm lnD is used as an abscissa, wherein D (in $\mu$m) represents the particle diameter of a toner particle, while being divided into a plurality of classes at intervals of 0.23, and the number of particles is used as an ordinate.

It is preferable that the toner has a number average particle diameter of 2 to 7 $\mu$m.

The above-described toner particle is preferably produced by a production method having a process for polymerizing of a polymerizable monomer in an aqueous medium to form the resin particles.

The toner particle is preferably produced by a production method having a process for coagulating and adhering by fusion the resin particles.

The toner particle is preferably produced by a production method having a process in which the resin particles and the colorant particles are salted-out and adhered by fusion.

The toner particle is preferably produced by a production method having a process for producing the resin particle by multi-step polymerization and a process for salting-out and adhering by fusion the resin particles and the colorant particles.

The toner particle is preferably produced by the above-described production methods.

The toner particle is preferably produced by a production method having a process for adhering by fusion the resin particle onto the surface of the colorant particle by salting-out and adhering by fusion.

The toner is preferably applied for an image forming method by which a static latent image formed on a photoreceptor by digital exposure is visualized.

The toner is preferably applied for an image forming method in which the toner is repeatedly used by recycling.

The toner is preferably applied for an image forming apparatus which has a developing means for visualizing the static latent image formed on the photoreceptor by the use of the toner for developing the static charged image, a transfer means for transferring the visualized image onto a image receiving medium, and a fixing means for fixing by heat the visualized image transferred on the image receiving medium, and the light exposure to the photoreceptor is carried out by digital exposure and the ozone concentration in the atmosphere of the developing means is from 0.1 to 10 ppm.

The toner is preferably applied for an image forming apparatus which has a developing means for visualizing the static latent image formed on the photoreceptor by the use of the toner for developing the static charged image, a transfer means for transferring the visualized image onto a image receiving medium, a fixing means for fixing by heat the visualized image transferred on the image receiving medium and a means for recycling the toner.

BRIEF DESCRIPTION OF DRAWINGS

FIG. 1(*b*) shows a schematic view of cross section of a toner particle containing a releasing agent.

FIGS. 7(*b*) and 7(*c*) each shows a schematic view of project image of toner image having a corner.

DETAILED DESCRIPTION OF THE INVENTION

The invention is described in detailed below.

The invention relates to a toner having itself a high resistivity against ozone, a production method thereof, and an image forming method using the toner. In the toner particle according to the invention, the resin constituting the toner particle has a cell structure, and the average value of the FERE-horizontal diameter of the cells is from 20 to 200 nm and the variation coefficient of the FERE-horizontal diameter is from 10 to 35%. It has been found that the toner according to the invention having the cell structure does not form fine powdered particle even when the toner particle is subjected to the mechanical shearing stress caused by the stirring in the developing device or exposing to action of zone contained in a atmosphere in the developing device.

The cell structure is described below referring to the structure of the cell of organisms. The toner particle having the cell structure is constituted by a resin phase as a cell wall corresponding to the cell wall of the organisms and a resin phase as a cell enveloped by the cell wall corresponding to the cytoplasm. A part of the cell wall may be opened to connect with the cell wall of the adjacent cell. In the toner according to the invention, it is confirmed by observation on the cross-section of the toner particle after treatment by ozone plasma as later-mentioned that the resin constituting the toner particle forms a collection of plural independent cells through the cell wall without mixing.

Figure 1:
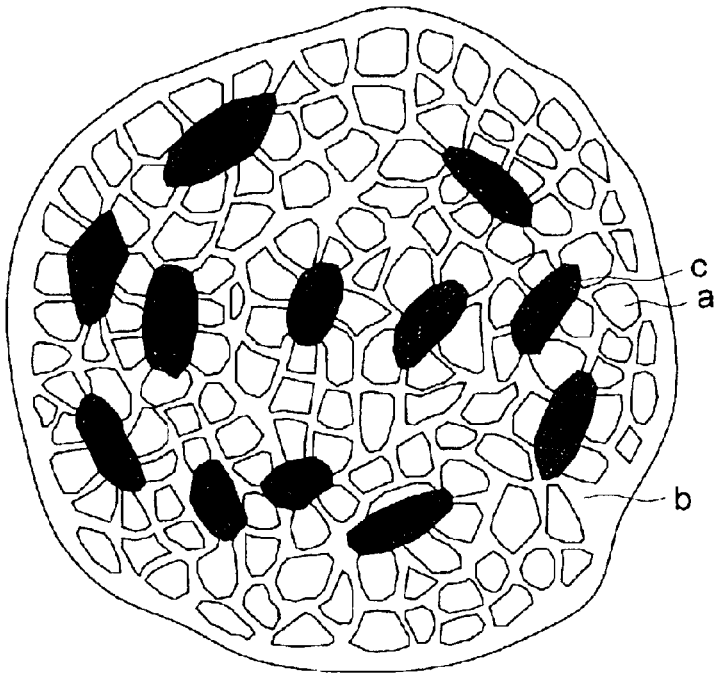
FIG. 1(*a*) shows a schematic view of cross section of a toner particle.
Figure 1:
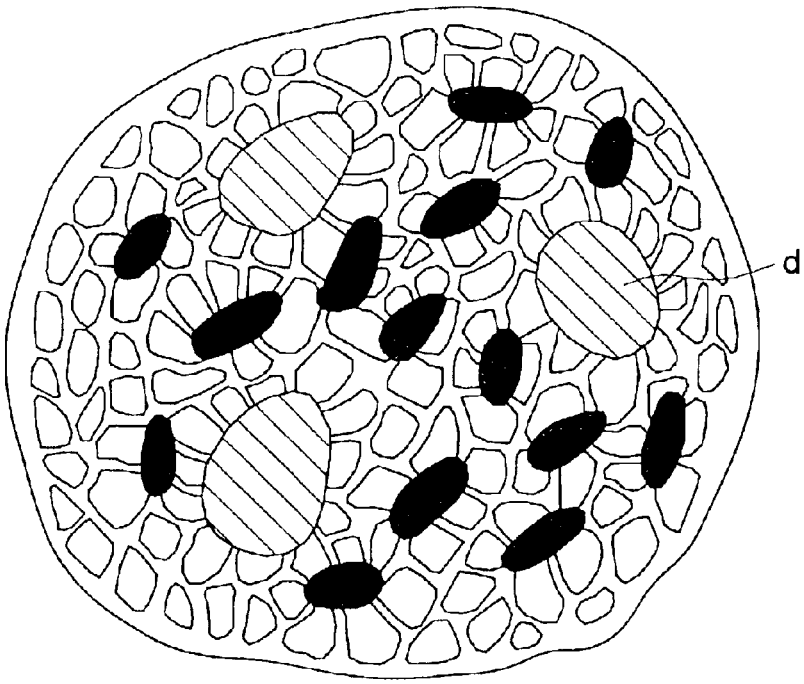

In the invention, the resin constituting the toner particle has the cell structure and the toner particle has the cross section as the schematic drawing shown in FIG. 1. As shown in FIG. 1, the toner particle according to the invention is constituted by a collection of the cells which are each separated by the resin phase so called as the cell wall.

The cell and the cell wall can be distinguished by the difference of brightness of the cell region and that of the cell wall region in the observation field of an electron-microscope caused by the difference, for example, of the crystallizing degree, the molecular weight and the amount of impurity such as a salt even when the resin compositions of the cell and that of the cell wall are the same. The schematic drawing of FIG. 1 is made based on the later-mentioned transmission electron-microscopic photograph. The toner particle is sliced and the sliced surface is observed to prepare the drawing. The sliced toner particle is subjected to the treatment by plasma for making the sample so as to be easily observed. In FIG. 1, the size of the cell is shown larger than the actually observed size compared with the diameter of the toner particle for clearly showing that the resin constituting the toner particle has the cell and the cell wall. In FIGS. 1(A) and 1(B) a, b, c and d each represents the cell, cell wall, colorant and crystalline substance, respectively.

Although the reason of the large effects of the cell structure on the durability of the toner is not cleared yet, it can be thought, for example, as follows.

It is supposed that the toner particle has the small elastic structure with no brittleness since the interior thereof has the cell structure by which a buffering structure is formed inside the particle. Therefore, the stress is diffused into the interior of the toner particle when the particle is subjected to the mechanical stress, and the fine powder is not formed and the durability is maintained. Particularly, it is supposed that the resin is oxidized and tend to be decomposed in the atmosphere in which ozone is generated. Under such the condition, the fine powder of the toner tends to be formed. However, when the toner particle has the cell structure, the cell functions as a brier for inhibiting the progress of the influence of ozone into the inside of the toner particle. Thus the problem of the decomposition by ozone may be solved.

The reason of the barrier effect against ozone of the toner particle according to the invention is not cleared yet. It is supposed, however, that a part easily decomposed by ozone and that difficultly decomposed by ozone are mingled with together in the resin constituting the toner particle. Namely, it is supposed that the part easily decomposed by ozone constitutes the particle-shaped cell is at the central portion of the toner particle, and the part difficultly decomposed by ozone constitutes the cell wall in the cell structure of the toner particle according to the invention. The toner particle according to the invention has plural cells, preferably not less than 10 cells, even though the particle having only one cell satisfying the foregoing requirement regarding the FERE-horizontal diameter may be used.

The toner particle is preferably one having a structure in which the cells are sparsely distributed in the circumferential portion of the toner particle.

In the toner particle having the cell structure according to the invention, the colorant particles are distributed between the cells as shown in FIG. 1. It is preferable that not less than 60% in number of the whole number of the colorant particles in the toner particle are distributed between the cells. It is confirmed as to the toner particle according to the invention that one having a higher ratio of the colorant particle distributed between the cells has a higher durability, and one is particularly preferred in which not less than 80% in number of the whole number of the colorant particles in the toner particle are distributed between the cells.

The reason of the higher durability of the toner particle having the higher ratio of the colorant particle distributed between the cells is not cleared. It is supposed, however, that the durability of the toner particle is raised since the colorant particle functions itself as the wall of the cell to display the buffer ability in the interior of the toner particle and the barrier ability against ozone.

The toner particle according to the invention preferably contains a toner component such as a coagulating salt or a crystalline substance in higher concentration at the cell wall portion additionally the colorant particles.

The size of the cell in the toner particle having the cell structure according to the invention is from 20 to 200 nm in the average value of the FERE-horizontal diameter from the viewpoint of that the fine powder of the toner is difficultly occurred and the desired durability of the toner is satisfied even when the mechanical shearing tress is applied or the influence of ozone is given.

It is supposed that the resin constituting the cell wall suitably absorbs the mechanical shock given to the toner particle and the cell is difficultly influenced by ozone when the average value of the FERE-horizontal diameter of the toner particle is from 20 to 200 nm.

The average FERE-horizontal diameter of the toner particle having the cell structure according to the invention is preferably from 40 to 160 nm, particularly preferably from 60 to 120 nm. The FERE-horizontal diameter is a value specifying the size of the cell in the toner particle according to the invention; the FERE-horizontal diameter is the length or the longest axis of the cross section of the toner particle in the horizontal direction when the particle is stand in an optional state.

The values of the FERE-horizontal diameter of each the cells in the toner particle are scattered some degree as to the average value, and the variation coefficient of the FERE-horizontal diameter of the cell is from 10 to 35%, preferably from 10 to 25%, particularly preferably from 12 to 16%.

The variation coefficient of the FERE-horizontal diameters of the cells in the toner particle is calculated by the following equation:

$$\text{Variation coefficient of FERE-horizontal diameter}=\{S2/K2\}\times 100\%.$$

In the above equation, S2 is the standard deviation of the FERE-horizontal diameter of optionally selected 100 cells, and K2 is the average of the FERE-horizontal diameters.

As above-mentioned, the variation coefficient of the FERE-horizontal diameter shows the scattering degree of the FERE-horizontal diameter of each of the cells as to the average value of the FERE-horizontal diameter. In the invention, the variation coefficient of the FERE-horizontal diameter is from 10 to 35%; such the toner is preferred since that formation of the fine powder by the mechanical shearing stress or the influence of ozone is inhibited when the toner is used for the image formation.

The spherical degree of the cell contained in the toner particle according to the invention is from 0.75 to 0.98. The spherical degree is calculated by the following equation:

$$\text{Spherical degree}=[4\pi\times(\text{Sum of area of cells})/(\text{Sum of circumference length of cells})^2]$$

The value of the above equation is 1 when the shape of cell is true sphere, and is nearing 0 when the shape of the cell becomes more slender. In the invention, the shape of the cell is not true sphere and slender in some degree since the cell having such the shape is raised in the strength and the fine powder of the toner is difficultly formed.

The average diameter of the cell structure of the toner particle according to the invention can be obtained by a transmission electron-microscope. The FERE-horizontal diameter and other characteristics as to the call can be calculated by results of the image analysis of the photograph obtained by photographing the toner particle by the transmission electron microscope.

It is confirmed that the resin constituting the toner particle of the invention has the cell structure by the transmission electron-microscopic photograph since the brightness of the portion of the cell wall and that of the portion of the cell are different from each other in the photograph.

The difference of the brightness is appeared when the difference of the transmittance of electron beam is visualized since the electron beam transmittances of the components of the toner particle such as the binder resin and colorant are different from each other. Generally, the colorant is displayed as a low brightness or a high density image since the electron beam transmittance of the colorant is higher than that of the binder resin.

In the electron-microscopic photograph, it is usually defined that the low brightness is that within the range of from 0 to 99th step, the medium brightness is that within the range of from 80th to 160th step and the high brightness is that within the range of from 127th to 255th step when the brightness signals of the pixel is classified into 256 steps. In the invention, however, it is necessary only to relatively distinguish the components of the toner particle. Accordingly, it is not essential that the brightness of the colorant be within the range of the low brightness defined as above.

As the transmission electron microscope observing the structure of the toner particle of the invention, ones well known in the field of the toner production are suitably applied. For example, LEM-2000, manufactured by Topcon Co., Ltd., may be used. The values specified in the invention such as the number of the cell are calculated from the result of the transmission electron-microscopic photograph of projection image with a magnitude of 25,000 of 1,000 or more toner particles.

The concrete photographing procedure by the transmission electron microscope is carried out according to a usual method. For measuring the cross section of the toner particle, the toner particles are sufficiently dispersed in an epoxy resin capable of being solidified at an ordinary temperature and solidified for embedding, or the toner particles are dispersed in fine polystyrene powder having a particle size of approximately 100 nm and molded by pressure, and thus obtained block was sliced by a microtome having a diamond blade to obtain a sliced sample, the block may be dyed according to necessity by tetraruthenium trioxide or a combination of tetraruthenium trioxide and tetraosmium trioxide before the slicing.

The shape of the cross section of the toner particle in the sliced sample is photographed by the transmission electron microscope. The shape of the area occupied by the colorant is visually confirmed on thus obtained photograph and the values specified by the invention are calculated by processing the image information by the use of image analyzing apparatus "LUZEX F", manufactured by Nireco Co., Ltd., attached to the electron-microscope.

The acceleration voltage of the transmission electron microscope is preferably from 80 to 200 kV. It is preferred that the acceleration voltage is set at 80 kV or more for obtaining an electron-microscopic image having a sufficient high contrast.

It is preferable evaluating the cell structure to subject the toner to a treatment by ozone plasma. The cell structure can be made to easily observable by the ozone plasma treatment.

The ozone plasma treatment applied in the invention is described bellow.

The ozone plasma treatment apparatus is an apparatus for modifying the surface of the sample by plasma discharge using an active gas. Such the apparatus is usually used for removing an impurity on the sample surface or surface modifying such as etching, ashing or coating at the time of observation of a sample such as an inorganic material by an electron microscope for analytical use.

Plasma cleaner PC-2000, manufactured by South Bay Technology CO., Ltd., and Plasma Prep 5 manufactured by Gala Instrument CO., Ltd., are cited as concrete examples of such the apparatus. An example of the specification of the apparatus is as follows.

RF frequency: 13.56 MHz

RF Output: 0–150 W

Electrode: Stainless steel pin hole electrode

Cooling system: Water cooling

Usable gas: Ar, $O_2$, $CF_4$, $Cl_2$, $CCl_4$ etc, and an active gas

In the invention, the RF output is set at 100 W, and Ar and ozone gas are supplied by a gas supplier having a gas flow meter and a needle valve. The treatment is performed for five minutes by supplying argon gas and for five minutes by supplying ozone gas, for ten minutes in total, under a vacuum condition formed by a vacuum pump of 96 l/min.

In the ozone plasma treatment relating to the invention, the toner particle embedded in acryl resin and sliced by an ultra-microtome, and the sliced sample is placed on a copper mesh inserted into the chamber of the treating apparatus for subjecting to the ozone plasma treatment.

When oxygen gas is used as the active gas in the ozone plasma treatment, synthesized oil such as Fomblin oil is preferably used as the oil for vacuum pump.

The toner particle in the state of complete product containing an external additive and the independent toner particle are also usable as confirmation of the cell structure of the particle.

Figure 2:
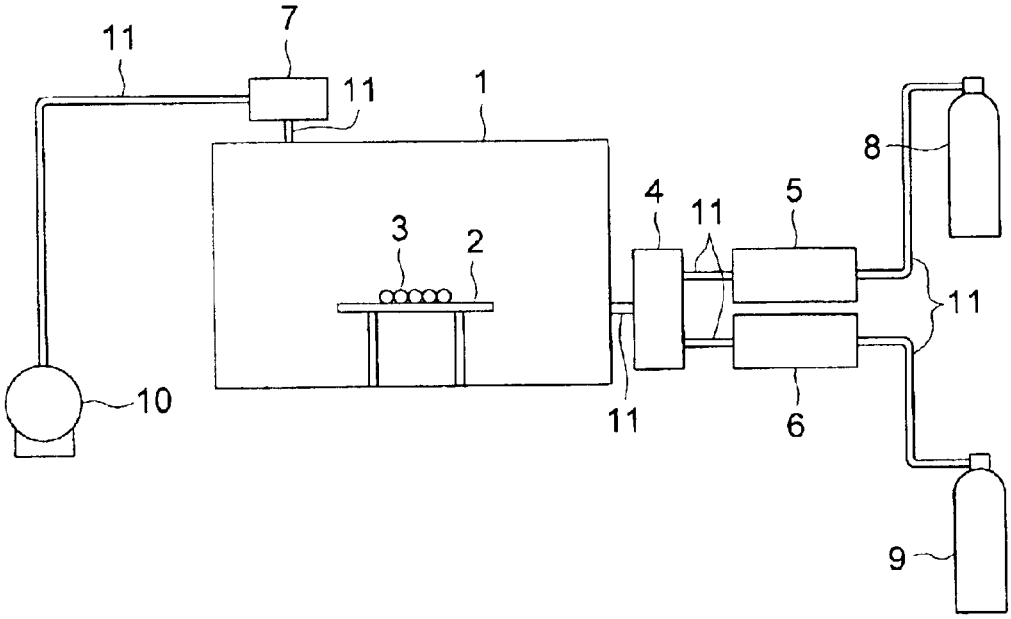
FIG. 2 shows a schematic view of an example of a plasma ozone treating apparatus which can be employed in the present invention.

The schematic side view drawing of the ozone plasma treatment apparatus usable in the invention is shown in FIG. 2.

The toner employed in the invention is detailed.

The toner having a variation coefficient of the toner shape coefficient of not more than 16 percent, as well as having a number variation coefficient in the is preferably employed because high image quality, which is exhibited by excellent cleaning properties, as well as excellent fine line reproduction, can be obtained over an extended period of time.

The inventor has found that a corner part of the toner particle becomes round during long time usage in the developing apparatus and the rounded part accelerates the additives embedded in the toner particle, whereby charging amount varies, and fluidity and cleaning ability are reduced. Such the toner is preferred since that formation of the fine powder by the mechanical shearing stress or the influence of ozone is inhibited when the toner is used for the image formation.

Further, by employing a toner in which the number ratio of toner particles, having no corners, is set at 50 percent and the number variation coefficient in the number size distribution is adjusted to not more than 27 percent, it is possible to obtain high image quality over an extended time of period, which exhibits excellent cleaning properties, as well as excellent fine line reproduction, and further formation of the fine powder by the mechanical shearing stress or the influence of ozone is inhibited when the toner is used for the image formation for long term.

The polymerized toner, which is preferably employed in the present invention, has a number ratio of toner particles having a shape coefficient of 1.2 to 1.6 and is at least 65 percent, and further the variation coefficient of said shape coefficient is not more than 16 percent. And it is possible to obtain high image quality over an extended time of period, which exhibits excellent cleaning properties, as well as excellent fine line reproduction, and further formation of the fine powder by the mechanical shearing stress or the influence of ozone is inhibited when the toner is used for the image formation for long term.

The number particle size distribution as well as the number variation coefficient of the toner of the present invention are measured by either a Coulter Counter TA-II or a Coulter Multisizer (both are manufactured by Coulter Co.). In the present invention, the Coulter Multisizer was used, which was connected to a particle size distribution output interface (manufactured by Nikkaki), via a personal computer. An aperture employed in said Coulter Multisizer was 100 $\mu$m, and the volume as well as the number of toner particles with at least 2 $\mu$m was measured to calculate the particle size distribution as well as the average particle diameter. The number particle size distribution as described herein represents the relative frequency of toner particles with respect to the toner diameter, and the number average particle diameter represents the median diameter in the number particle size distribution, that is Dn50.

The number variation coefficient in the number particle size distribution of toner is calculated by the formula described below:

$$\text{Number variation coefficient}=(S/Dn)\times 100 \text{ (in percent)}$$

In the formula S represents the standard deviation in the number particle size distribution, and $D_n$ represents the number average particle diameter (in $\mu$m).

The number variation coefficient of the toner of the present invention is generally not more than 27 percent, and is preferably not more than 25 percent. By controlling the number variation coefficient to be below 27 percent, voids in the transferred toner layer decrease to improve fixing property as well as to minimize offsetting. Further, the charge distribution narrows, and the transfer efficiency is enhanced, improving image quality.

Methods to control the number variation coefficient of the present invention are not particularly limited. For example, a method may be employed in which toner particles are classified employing forced airflow. However, in order to decrease the number variation coefficient, classification in liquid is more effective. Classifying methods in liquid include one in which a toner is prepared by classifying and collecting toner particles in response to the difference in sedimentation rate generated by the difference in particle diameter while controlling rotational frequency, employing a centrifuge.

The shape coefficient of the toner particles will be detailed. It is preferable the ratio of toner particles having a shape coefficient of 1.2 to 1.6 is 65 percent by number and variation coefficient of said shape coefficient is 16 percent. The shape coefficient of the toner particles is expressed by the formula described below and represents the roundness of toner particles.

$$\text{Shape coefficient}=[(\text{maximum diameter}/2)^2\times\pi]/\text{projection area}$$

In the formula the maximum diameter means the maximum width of a toner particle obtained by putting the projection image of said particle on a plane between two parallel lines, while the projection area means the area of the projected image of said toner on a plane. The shape coefficient was determined in such a manner that toner particles were photographed under a magnification factor of 2,000, employing a scanning type electron microscope, and the resultant photographs were analyzed employing "Scanning Image Analyzer", manufactured by JEOL LTD. At that time, 100 toner particles were employed and the shape coefficient was obtained employing the aforementioned calculation formula.

Figure 7:
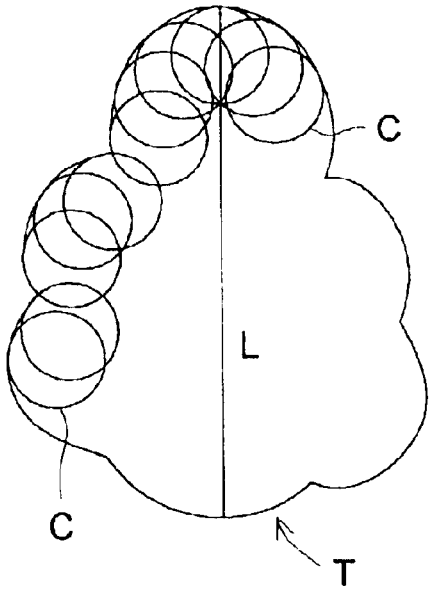
FIG. 7(*a*) shows a schematic view of project image of toner image having no corner.
Figure 7:
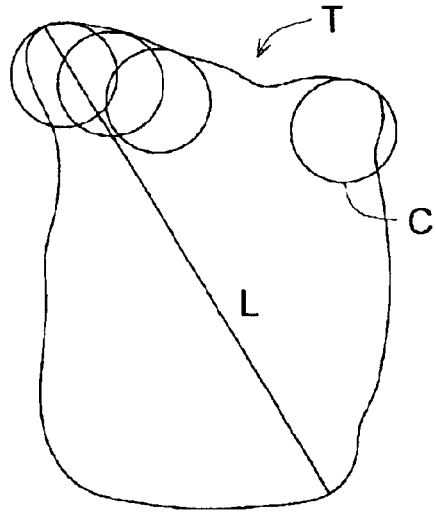
Figure 7:
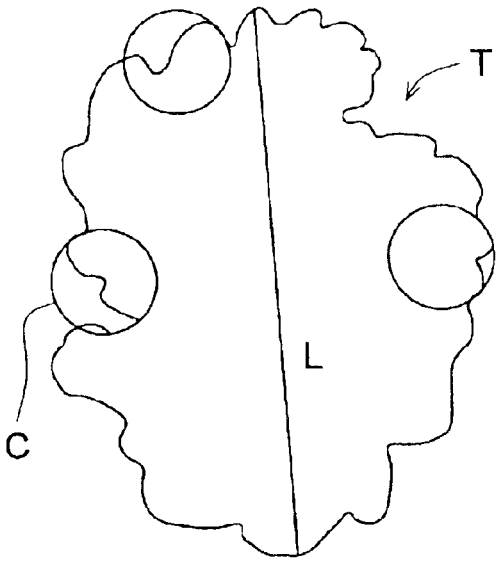

The toner particles of the present invention, which substantially have no corners, as described herein, mean those having no projection to which charges are concentrated or which tend to be worn down by stress. Namely, as shown in FIG. 7(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference.

Further, "the main axis of a toner particle" as described herein means the maximum width of said toner particle when the projection image of said toner particle onto a flat plane is placed between two parallel lines. Incidentally, FIGS. 7(*b*) and 7(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 1,000 toner particles.

In the toner of the present invention, the ratio of the number of toner particles having no corners is generally at least 50 percent, and is preferably at least 70 percent. By adjusting the ratio of the number of toner particles having no corners to at least 50 percent, the formation of fine toner particles and the like due to stress with a developer conveying member and the like tends not to occur. Thus it is possible to minimize the formation of a so-called toner which excessively adheres to the developer conveying member, and simultaneously minimizes staining onto said developer conveying member, as well as to narrow the charge amount distribution. Thus, since the charge amount distribution is narrowed, it is possible to stabilize chargeability, resulting in excellent image quality over an extended period of time. And further the toner is preferred since that formation of the fine powder by the mechanical shearing stress or the influence of ozone is inhibited when the toner is used for the image formation.

The toner having no corners can be obtained by various methods. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

The toner of the present invention preferably has a sum M of at least 70 percent. Said sum M is obtained by adding relative frequency m1 of toner particles, included in the most frequent class, to relative frequency m2 of toner particles included in the second frequent class in a histogram showing the particle diameter distribution, which is drawn in such a manner that natural logarithm lnD is used as an abscissa, wherein D (in $\mu$m) represents the particle diameter of a toner particle, while being divided into a plurality of classes at intervals of 0.23, and the number of particles is used as an ordinate.

By maintaining the sum M of the relative frequency m1 and the relative frequency m2 at no less than 70 percent, the variance of the particle diameter distribution of toner particles narrows. As a result, by employing said toner in an image forming process, the minimization of generation of selective development may be secured.

In the present invention, the above-mentioned histogram showing the particle diameter distribution based on the number of particles is one in which natural logarithm lnD (wherein D represents the diameter of each particle) is divided at intervals of 0.23 into a plurality of classes (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ), being based on the number of particles. Said histogram was prepared in such a manner that particle diameter data of a sample measured by a Coulter Multisizer according to conditions described below were transmitted to a computer via an I/O unit, so that in said computer, said histogram was prepared employing a particle diameter distribution analyzing program.

(Measurement Conditions)

Aperture: 100 $\mu$m

Sample preparation method: added to 50 to 100 ml of an electrolytic solution (ISOTON R-11, manufactured by Coulter Scientific Japan Co) is a suitable amount of a surface active agent (a neutral detergent) and stirred. Added to the resulting mixture is 10 to 20 mg of a sample to be measured. To prepare the sample, the resulting mixture is subjected to dispersion treatment for one minute employing an ultrasonic homogenizer.

The number average particle diameter of the toner is 2 to 7 micrometer, preferably 3 to 6.5, particularly 3.5 to 6 micrometer. Particle diameter is controlled by adjusting concentration of coagulant (salting agent), amount of organic solvent, fusing time, composition of polymer during the toner preparation. The transfer efficiency is improved, half-tone image quality, and fine line or dot image quality is improved by employing the toner having reduced number average diameter of 2 to 7 $\mu$m. The formation of the fine powder by the mechanical shearing stress or the influence of ozone is inhibited when the toner is used for the image formation for the toner according to the invention having reduced number average diameter and containing toner particle having cell structure since the load per unit volume applied to the toner particles is reduced.

It is possible to determine said volume average particle diameter of toner particles, employing a Coulter Counter TA-II, a Coulter Multisizer, SLAD 1100 (a laser diffraction type particle diameter measuring apparatus, produced by Shimadzu Seisakusho), and the like. In the present invention, the Coulter Multisizer was used, which was connected to a particle size distribution output interface (manufactured by Nikkaki), via a personal computer.

It has been found that the toner particle having the specified shape according to the invention is advantageous as to the resistivity against the powdering caused by the mechanical shearing stress and the decomposition by ozone.

The production method of the toner according to the invention is described bellow.

As the method for raising the adhesiveness between the resin particles, the adhesiveness between the particles can be raised by making a combined resin particle, the surface of which is constituted by accumulated layers of a low molecular weight component so as to raise the adhesiveness between the particles. The combined resin particle is described later in detail.

The colorant can be contained between the resin particles at the step of association of the particles by dispersing the colorant so that the diameter of the colorant becomes less than that of the resin particle at the step of the association. It is also preferable that a metal salt is included between the cell walls.

In such the method, a large amount of the metal salt can be included in the associated type toner so as to raise the durability of the particle by adding an excessive amount of salting-out agent at the time of association of the resin particles and the colorant particles.

Emulsion Polymerization

The toner according to the invention can be also obtained by salting-off/coagulating resin particles prepared by the emulsion polymerization or the mini-emulsion polymerization.

For example, the methods described in JP O.P.I. Nos. 5-265252, 6-329947 and 9-15904 are applicable. The toner can be produced by a method by which dispersed particles of constituting material such as resin particles and colorant or fine particles constituted by resin and colorant are associated several by several. Such the method is realized particularly by the following procedure: the particles are dispersed in water and the particles are salted-out by addition of a coagulation agent in an amount of larger than the critical coagulation concentration. At the same time, the particles are gradually grown by melt-adhesion of the particles by heating at a temperature higher than the glass transition point of the produced polymer. The particle growing is stopped by addition of a large amount of water when the particle size is reached at the prescribed diameter. Then the surface of the particle is made smooth by heating and stirring to control the shape of the particles. The particles containing water in a fluid state are dried by heating. Thus the toner can be produced. In the foregoing method, an infinitely water-miscible solvent such as alcohol may be added together with the coagulation agent.

The toner particles are prepared by a process of salting/coagulation of fine particles obtained by polymerization and a colorant. A crystalline material is incorporated in polymerizable monomer liquid in a melted or dissolved state during at least a part of the polymerization process.

The toner particles according to the invention are preferably prepared by salting-off/coagulating composite resin particles prepared by the multi-step polymerization. The preparation method of composite resin particles obtained by multi-step polymerization (Multi-Step Polymerization Process)

The multi-step polymerization process is a process for preparing the composite resin particle. A plural of polymerization reaction is conducted in separate steps so that each particle has different layers having different molecular weight. The obtained particle has a gradient of molecular weight from the center to the surface of the particle. For example, a lower molecular weight surface layer is formed by adding a polymerizable monomer and a chain transfer agent after obtaining a higher molecular weight polymer particles dispersion.

It is preferred from the viewpoint of the stabile formation of cell structure of the obtained toner to apply the multi-step polymerization including three or more polymerization steps. The two- and tree-step polymerization methods, which are representative examples, are described below. It is preferable that the closer to the surface the molecular weight is lower in view of the anti-crush strength.

(Two-Step Polymerization Method)

The two-step polymerization method is a method for producing the composite resin particle comprised of the central portion (core) comprising the high molecular weight resin and an outer layer (shell) comprising the low molecular weight resin.

In concrete, a monomer liquid is dispersed in an aqueous medium (an aqueous solution of a surfactant) in a form of oil drop, and the system is subjected to a polymerization treatment (the first polymerization step) to prepare a dispersion of a higher molecular weight resin particles. A functional material such as a releasing agent may be incorporated in the high-molecular weight component which forms core portion.

Next, a polymerization initiator and a monomer to form the lower molecular weight resin is added to the suspension of the resin articles, and the monomer is subjected to a polymerization treatment (the second polymerization step) to form a covering layer composed of the lower molecular weight resin (a polymer of the monomer) onto the resin particle.

(Three-Step Polymerization Method)

The three-step polymerization method is a method for producing the composite resin particle comprised of the central portion (core) comprising the high molecular weight resin, the inter layer and the outer layer (shell) comprising the low molecular weight resin.

In concrete, a suspension of the resin particles prepared by the polymerization treatment (the first polymerization step) according to a usual procedure is added to an aqueous medium (an aqueous solution of a surfactant) and a monomer is dispersed in the aqueous medium. The aqueous dispersion system is subjected to a polymerization treatment (the second polymerization step) to form a covering layer (inter layer) comprising a resin (a polymer of the monomer) containing the crystalline material onto the surface of the resin particle (core particle). Thus a suspension of combined resin (higher molecular weight resin-middle molecular weight resin) particles is prepared.

Next, a polymerization initiator and a monomer to form the lower molecular weight resin is added to the dispersion of the combined resin particles, and the monomer is subjected to a polymerization treatment (the third polymerization step) to form a covering layer composed of the low molecular weight resin (a polymer of the monomer) onto the composite resin particle.

In the three-step polymerization method, the functional material such as crystalline material can be finely and uniformly dispersed by applying a procedure, at the time of forming the inter layer on the resin particle.

The water based medium means one in which at least 50 percent, by weight of water, is incorporated.

Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and so on which do not dissolve resins.

A method suitable for forming a resin particle or cover layer containing a functional material such as a releasing agent is preferred in which dispersion is carried out employing mechanical force. Said monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

In the usual emulsion polymerization method, the crystalline material dissolved in oil phase tends to desorb. On the other hand sufficient amount of the functional material can be incorporated in a resin particle or covered layer by the mini-emulsion method in which oil droplets are formed mechanically.

Herein, homogenizers to conduct oil droplet dispersion, employing mechanical forces, are not particularly limited, and include, for example, "Clearmix", ultrasonic homogenizers, mechanical homogenizers, and Manton-Gaulin homogenizers and pressure type homogenizers.

The diameter of dispersed particles is 10 to 1,000 nm, and is preferably 30 to 300 nm.

The particle diameter of composite particles obtained by the process (1) is preferably from 10 to 1,000 nm in terms of weight average diameter determined employing an electrophoresis light scattering photometer "ELS-800" (produced by Ohtsuka Denshi Co.).

Glass transition temperature (Tg) of the composite resin particles is preferably from 48 to 74° C., and more preferably from 52 to 64° C. The Softening point of the composite resin particles is preferably from 95 to 140° C.

The toner according to the invention is prepared by that a resin layer is formed on the surface of the resin and colored particle fusing resin particles by salting-out/fusion method. The method is detailed below.

<Colored Particle>

The colored particles are subjected to salting out/fusion process in a state that they are dispersed in water based medium.

The water based medium to disperse the colored particles includes an aqueous solution dissolving a surfactant in concentration not less than critical micelle concentration (CMC).

Homogenizers employed in the dispersion of the colored particles include, for example, "Clearmix", ultrasonic homogenizers, mechanical homogenizers, and Manton-Gaulin homogenizers and pressure type homogenizers.

<Salting-Out/Fusion Process>

Salting-out/fusion process is a process to obtain toner particles having undefined shape (aspheric shape) in which the resin particles obtained by the foregoing process and colored particles are aggregated.

Salting-out/fusion process is that the processes of salting-out (coagulation of fine particles) and fusion (distinction of surface between the fine particles) occur simultaneously, or the processes of salting-out and fusion are induced simultaneously. Particles (resin particles and colored particles) must be subjected to coagulation in such a temperature condition as lower than the glass transition temperature (Tg) of the resin composing the resin particles so that the processes of salting-out (coagulation of fine particles) and fusion (distinction of surface between the fine particles) occur simultaneously.

Particles of additives incorporated within toner particles such as a charge control agent (particles having average diameter from 10 to 1,000 nm) may be added as well as the resin particles and the colored particles in the salting-out/fusion process. Surface of the colored particles may be modified by a surface modifier.

In order to simultaneously carry out salting-out and fusion, it is required that salting agent (coagulant) is added to the dispersion of resin particles and colored particles in an amount not less than critical micelle concentration and they are heated to a temperature of the glass transition temperature (Tg) or higher of the resin particles.

Suitable temperature for salting out/fusion is preferably from (Tg plus 10° C.) to (Tg plus 50° C.), and more preferably from (Tg plus 15° C.) to (Tg plus 40° C.).

An organic solvent which is dissolved in water infinitely may be added in order to conduct the salting out/fusion effectively.

Further, in the present invention, after preparing colored particles (in the present invention, called toner particles) upon salting out, aggregating, and coalescing resin particles and colorants in a water based medium, separation of said toner particles from said water based medium is preferably carried out at a temperature of not lower than the Krafft point of the surface active agents in said water based medium, and is more preferably carried out in the range of said Krafft point to said Krafft point plus 20° C.

The Krafft point, as described herein, refers to the temperature at which an aqueous solution comprising a surface active agent starts to become milky-white. The Krafft point is measured as follows.

<<Measurement of Krafft Point>>

A solution is prepared by adding a coagulant in a practically employed amount to a water based medium employed in salting-out, aggregation, and coalescence processes, namely a surface active agent solution. The resulting solution is stored at 1° C. for 5 days. Subsequently, the resulting solution is heated while stirring until it becomes transparent. The temperature, at which said solution becomes transparent, is defined as its Krafft point.

From the viewpoint of forming the cell structure efficiently, the toner of the present invention preferably comprises the aforesaid metal elements (listed as such forms are metals and metal ions) in an amount of 350 to 35,000 ppm in said toner and more preferably in an amount of 500 to 30,000 ppm.

It is possible to obtain the content of metal ions in toner by measuring the intensity of fluorescent X-rays emitted from metal species of metal salts (for example, calcium derived from calcium chloride) employed as coagulants, employing a fluorescence X-ray analyzer "System 3270 Type" (manufactured by Rigaku Denki Kogyo Co., Ltd.). One specific measurement method is as follows. A plurality of toners comprising coagulant metal salts, whose content ratios are known, is prepared, and 5 g of each toner is pelletized. Then, the relationship (a calibration curve) between the content ratio (ppm by weight) of said coagulant metal salts and the fluorescent X-ray intensity (being its peak intensity) is obtained. Subsequently, a toner (a sample), whose content ratio of the coagulant metal salt is to be measured, is pelletized in the same manner and fluorescent X-rays emitted from the metal species of said coagulant metal salt is measured, whereby it is possible to obtain the content ratio, namely content of metal ions in said toner.

The cell structure can be obtained efficiently by making the salt adsorbed at the surface a little larger than the center during the process of salting-out/coagulation and further continuing the salting-out/coagulation.

The amount of the salt contained in the particle is controlled by employing polymer dispersant at least a part of the amount of the surfactant.

Concrete example of the polymer dispersant includes polyvinyl alcohol, polyvinyl pyrrolidone and polyacrylic acid, having, preferably, molecular weight of 3,000 to 10,000.

(Digestion Process)

The digestion process is a process following to the salting-out/fusion process, wherein the agitation is continued with constant strength keeping temperature between Tg plus 15 and 40 centigrade of the resin, after the coagulation of fine particles. In this process the resin particles and the colored particles are fused and cell structure in the toner can be formed.

(Filtration and Washing Process)

In the filtration and washing process, filtration is carried out in which said toner particles are collected from the toner particle dispersion, and washing is also carried out in which additives such as surface active agents, salting-out agents, and the like, are removed from the collected toner particles (a cake-like aggregate).

Herein, filtering is carried out by a centrifugal separation method, a vacuum filtration method which is carried out employing Buchner funnel and the like, a filtration method which is carried out employing a filter press, and the like.

(Drying Process)

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Each of the constituting materials used in the toner producing process is described in detail below.

(Polymerizable Monomer)

A hydrophobic monomer is essentially used as the polymerizable monomer for producing the resin or binder used in the invention and a cross-linkable monomer is used according to necessity. As is described below, it is preferable to contain at least one kind of a monomer having an acidic polar group and a monomer having a basic polar group.

Hydrophobic Monomer

The hydrophobic monomer can be used, one or more kinds of which may be used for satisfying required properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like. Listed as diolefin based monomers are butadiene, isoprene, chloroprene, and the like.

Listed as halogenated olefin based monomers are vinyl chloride, vinylidene chloride, vinyl bromide, and the like.

(2) Crosslinking Monomers

In order to improve the desired properties of toner, added as crosslinking monomers may be radical polymerizable crosslinking monomers. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Monomer Having an Acidic Polar Group

As the monomer having an acidic polar group, (a) an α,β-ethylenically unsaturated compound containing a carboxylic acid group (—COOH) and (b) an α,β-ethylenically unsaturated compound containing a sulfonic acid group (—$SO_3H$) can be cited.

Examples of said α,β-ethylenically unsaturated compound containing the carboxylic acid group (—COOH) of (a) include acrylic acid, methacrylic acid, fumaric acid, maleic acid, itaconic acid, cinnamic acid, maleic acid monobutyl ester, maleic acid mono-octyl ester and their sodium salts, zinc salts, etc.

Examples of said α,β-ethylenically unsaturated compound containing the sulfonic acid group (—$SO_3H$) of (b) include sulfonated styrene and its Na salt, allylsulfo succinic acid, allylsulfo succinic acid octyl ester and their sodium salts.

(4) Monomer Having a Basic Polar Group

As the monomer having a basic polar group, can be cited (i) (meth)acrylic acid ester obtained by reacting (meth) acrylic acid with an aliphatic alcohol, which has 1 to 12 carbon atoms, preferably 2 to 8 carbon atoms, specifically preferably 2 carbon atoms, and which also has an amino group or a quaternary ammonium group, (ii) (meth)acrylic acid amide or (meth)acrylic acid amide having mono-alkyl group or di-alkyl group, having 1 to 18 carbon atoms, substituted on its N atom, (iii) vinyl compound substituted with a heterocyclic group having at least a nitrogen atom in said heterocyclic group, (iv) N,N-di-allyl-alkylamine or its quaternary salt. Of these, (meth)acrylic acid ester obtained by reacting (meth)acrylic acid with the aliphatic alcohol having the amino group or the quaternary ammonium group is preferred.

Examples of (meth)acrylic acid ester obtained by reacting (meth)acrylic acid with the aliphatic alcohol having the amino group or the quaternary ammonium group of (i) include dimethylaminoethylacrylate, dimethylaminoethylmethacrylate, diethylaminoethylacrylate, diethylaminoethylmethacrylate, quaternary ammonium salts of the above mentioned four compounds, 3-dimethylaminophenylacrylate and 2-hydroxy-3-methacryloxypropyl trimethylammonium salt, etc.

Examples of (meth)acrylic acid amide or (meth)acrylic acid amide having mono-alkyl group or di-alkyl group substituted on its N atom of (ii) include acrylamide, N-butylacrylamide, N,N-dibutylacrylamide, piperidylacrylamide, methacrylamide, N-butylmethacrylamide, N,N-dimethylacrylamide, N-octadecylacrylamide, etc.

Examples of vinyl compound substituted with a heterocyclic group having at least a nitrogen atom in said heterocyclic group of (iii) include vinylpyridine, vinylpyrrolidone, vinyl-N-methylpyridinium chloride, vinyl-N-ethylpyridinium chloride, etc.

Examples of N,N-di-allyl-alkylamine or its quaternary salt of (iv) include N,N-di-allyl-methylammonium chloride, N,N-di-allyl-ethylammonium chloride, etc.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 80° C. is employed. However, by employing a combination of polymerization initiators such as hydrogen peroxide-reducing agent (ascorbic acid and the like), which is capable of initiating the polymerization at room temperature, it is possible to carry out polymerization at room temperature or higher.

(Chain Transfer Agents)

For the purpose of regulating the molecular weight of resin particles, it is possible to employ commonly used chain transfer agents.

The chain transfer agents, for example, employed are octylmercaptan, dodecylmercaptan, tert-dodecylmercaptan, ethyl thioglycolate, propyl thioglycolate, butyl thioglycolate, t-butyl thioglycolate, ethylhexyl thioglycolate, octyl thioglycolate, decyl thioglycolate, dodecyl thioglycolate, and an ethyleneglycol compound having mercapto group. Among them n-octyl-3-mercaptopropionic acid ester and n-octylmercaptan is preferable in view of minimizing smell at the time of thermal fixing.

(Surface Active Agents)

In order to perform polymerization, particularly mini-emulsion polymerization, employing the aforementioned radical polymerizable monomers, it is required to conduct oil droplet dispersion in a water based medium employing surface active agents. Surface active agents employed for the dispersion, include ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

In the present invention, surface active agents represented by General Formulas (1) and (2) are most preferably employed.

$R^1(OR^2)_nOSO_4M$ General Formula (1)

$R^1(OR^2)_nSO_3M$ General Formula (2)

In General Formulas (1) and (2), $R^1$ represents an alkyl group having from 6 to 22 carbon atoms or an arylalkyl group. $R^1$ is preferably an alkyl group having from 8 to 20 carbon atoms or an arylalkyl group and is more preferably an alkyl group having from 9 to 16 carbon atoms or an arylalkyl group.

Listed as alkyl group having from 6 to 22 carbon atoms represented by $R^1$ are, for example, an n-hexyl group, an n-heptyl group, an n-octyl group, an n-decyl group, an n-undecyl group, a hexadecyl group, a cyclopropyl group, a cyclopentyl group, and a cyclohexyl group. Listed as arylalkyl groups represented by $R^1$ are a benzyl group, a diphenylmethyl group, a cinnamyl group, a styryl group, a trityl group, and a phenethyl group.

In General Formulas (1) and (2), $R^2$ represents an alkylene group having from 2 to 6 carbon atoms. $R^2$ is preferably an alkylene group having 2 or 3 carbon atoms. Listed as alkylene groups having from 2 to 6 carbon atoms represented $R^2$ are an ethylene group, a trimethylene group, a tetramethylene group, a propylene group, and an ethylethylene group.

In General Formulas (1) and (2), n represents an integer of 1 to 11; and n is preferably from 2 to 10, is more preferably from 2 to 5, and is most preferably 2 or 3.

In General Formulas (1) and (2), listed as univalent metal elements represented by M are sodium, potassium, and lithium. Of these, sodium is preferably employed.

Specific examples of surface active agents represented by General Formulas (1) and (2) are illustrated below:

Compound (101): $C_{10}H_{21}(OCH_2CH_2)_2OSO_3Na$

Compound (102): $C_{10}H_{21}(OCH_2CH_2)_3OSO_3Na$

Compound (103): $C_{10}H_{21}(OCH_2CH_2)_2OS_3Na$

Compound (104): $C_{10}H_{21}(OCH_2CH_2)_3OSO_3Na$

Compound (105): $C_8H_{17}(OCH_2CH(CH_3))_2OSO_3Na$

Compound (106): $C_{18}H_{37}(OCH_2CH_2)_2OSO_3Na$ (Molecular Weight Distribution of Resin Particles and Toner)

Resins used in the toner has a peak or a shoulder within the ranges of preferably from 100,000 to 1,000,000 and from 1,000 to 50,000, and more preferably in the ranges from 100,000 to 1,000,000, from 25,000 to 150,000 and from 1,000 to 50,000 in the molecular weight distribution.

The resin particles preferably comprises "a high molecular weight resin" having a peak or a shoulder within the range of from 100,000 to 1,000,000, and "a low molecular weight resin" having a peak or a shoulder within the range of from 1,000 to 50,000, and more preferably "a middle molecular weight resin" having a peak or a shoulder within the range of from 15,000 to 100,000, in the molecular weight distribution.

Molecular weight of the resin composing toner is preferably measured by gel permeation chromatography (GPC) employing tetrahydrofuran (THF).

Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 $\mu$m, the filtrate is injected in a GPC.

Measurement conditions of GPC are described below. A column is stabilized at 40° C., and THF is flowed at a rate of 1 cc per minute. Then measurement is carried out by injecting approximately 100 $\mu$l of said sample at a concentration of 1 mg/cc. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

(Coagulants)

The coagulants selected from metallic salts are preferably employed in the processes of salting-out, coagulation and fusion from the dispersion of resin particles prepared in t e aqueous medium. The two or three valent metal salt is preferable to monovalent metal salt because of low critical coagulation concentration (coagulation point).

Particularly the multi-valent metal salt is preferred for forming the cell structure in the toner particle efficiently.

Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc.

Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application, and the two or three valent metal salt is preferable because of low critical coagulation concentration (coagulation point).

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to particle dispersion while changing the salt concentration to measure the $\zeta$ potential of the dispersion, and in addition the critical coagulation concentration may be obtained as the salt concentration which initiates a variation in the $\zeta$ potential.

The polymer particles dispersion liquid is processed by employing metal salt so as to have concentration not less than critical coagulation concentration. In this instance the metal salt is added directly or in a form of aqueous solution optionally, which is determined according to the purpose. In case that it is added in an aqueous solution the metal salt must satisfy the critical coagulation concentration including the water as the solvent of the metal salt.

The concentration of coagulant may be not less than the critical coagulation concentration. The amount of the added coagulant is preferably at least 1.2 times of the critical coagulation concentration, and more preferably 1.5 times because of the formation of cell structure of the toner particle.

<Colorants>

The toner is obtained by salting out/fusing the composite resin particles and colored particles.

Listed as colorants which constitute the toner of the present invention may be inorganic pigments, organic pigments, and dyes.

Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

The magnetite is incorporated in the toner particle when it is employed as a magnetic toner. The preferable amount is 20 to 60% by weight of the toner in view of endowing necessary magnetic characteristics.

Specific organic pigments as well as dyes are exemplified below.

The organic pigment or organic dye is also employed, examples thereof are listed.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment yellow 180, C.I. Pigment Yellow 185, Pigment Yellow 155, Pigment Yellow 186, C.I. Pigment Yellow 155, C.I. Pigment Yellow 156, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 49, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

These organic pigments, as well as dyes, may be employed individually or in combination of selected ones. Further, the added amount of pigments is commonly between 2 and 20 percent by weight, and is preferably between 3 and 15 percent by weight.

Said colorants may also be employed while subjected to surface modification. As the surface modifying agents preferably employed may be silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane.

Examples of the titanium coupling agent include those marketed with brand "Plainact" TTS, 9S, 38S, 41B, 46B, 55, 138S, 238S etc., by Ajinomoto Corporation, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include "Plainact AL-M".

These surface modifiers is added preferably in amount of 0.01 to 20% by weight, and more preferably 0.5 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

(Releasing Agents/Crystalline Materials)

Toner employed in the invention is preferably prepared by fusing colored particles and resin particles containing a releasing agent in water based medium and then digesting the obtained particles whereby the releasing agent are coagulated adequately to form a cell structure. The digestion is a process subjecting the fused particles to continuing agitation at a temperature of melting point of the crystalline material plus minus 20 centigrade.

Preferable examples of the releasing agent include low molecular weight polypropylene having average molecular weight of 1,500 to 9,000 and low molecular weight polyethylene, and a particularly preferable example is an ester compounds represented by General Formula (1), described below.

$$R^{11}—(OCO—R^{12})_n \quad (1)$$

wherein n represents an integer of 1 to 4, and preferably 2 to 4, more preferably 3 or 4, and in particular preferably 4, $R^{11}$ and $R^{12}$ each represent a hydrocarbon group which may have a substituent respectively. $R^{11}$ has from 1 to 40 carbon atoms, and preferably 1 to 20, more preferably 2 to 5. $R^{12}$ has from 1 to 40 carbon atoms, and preferably 16 to 30, more preferably 18 to 26.

The representative examples are listed.

1) $CH_3—(CH_2)_{12}—COO—(CH_2)_{17}—CH_3$
2) $CH_3—(CH_2)_{18}—COO—(CH_2)_{17}—CH_3$
3) $CH_3—(CH_2)_{20}—COO—(CH_2)_{21}—CH_3$
4) $CH_3—(CH_2)_{14}—COO—(CH_2)_{19}—CH_3$
5) $CH_3—(CH_2)_{20}—COO—(CH_2)_6—O—CO—(CH_2)_{20}—CH_3$

6)

$$CH_3—(CH_2)_{20}—COO—(CH_2)_2—\overset{\overset{\displaystyle CH_3}{|}}{CH}—CH_2—O—CO—(CH_2)_{20}—CH_3$$

-continued

7)

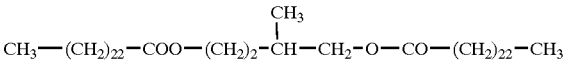

8)

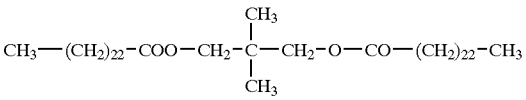

9)

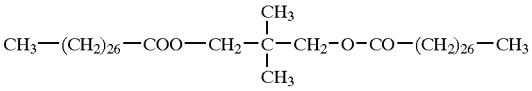

10)

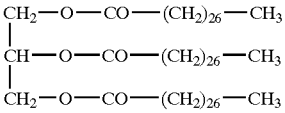

11)

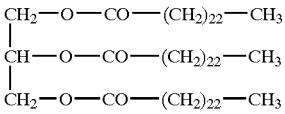

12)

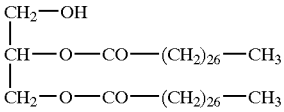

13)

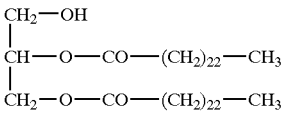

14)

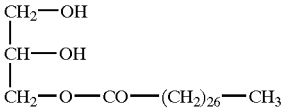

15)

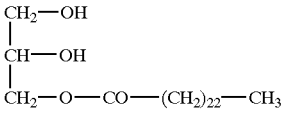

16)

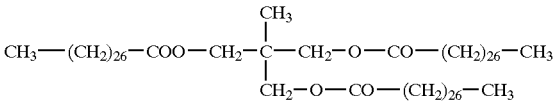

17)

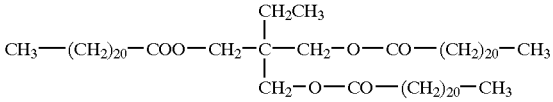

-continued

18)

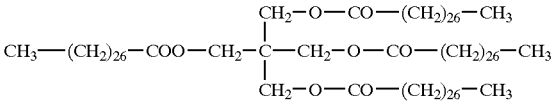

19)

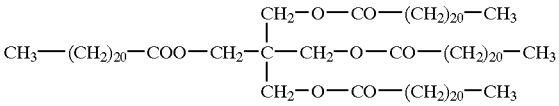

20)

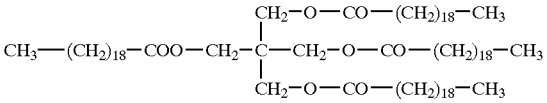

21)

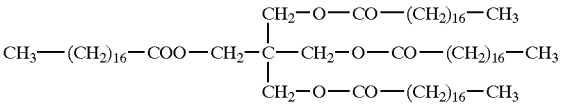

22)

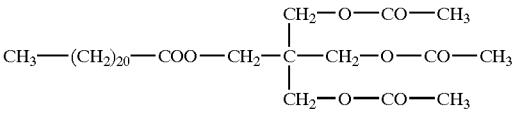

Crystalline polyester can be employed in addition to the releasing agent. As a compound constituting crystalline polyester obtained by reaction of aliphatic diol with an aliphatic dicarboxylic acid (acid anhydride and acid chloride are included) is preferable.

Example of the diol which is used in order to obtain crystalline polyester includes ethylene glycol, diethylene glycol, triethylene glycol, 1,2-propylene glycol, 1,3-propylene glycol, 1,4-butane diol, 1,4-butene diol, neopentyl glycol, 1,5-pentane glycol, 1,6-hexane glycol, 1,4-cyclohexane diol, 1,4-cyclohexane di methanol, dipropylene glycol, polyethylene glycol, polypropylene glycol, poly tetramethylene glycol, bisphenol A, bisphenol Z, and hydrogenated bisphenol A.

As the dicarboxylic acid which is use in order to obtain crystalline polyester and crystalline polyamide, oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecyl succinic acid, n-dodecenyl succinic acid, iso dodecyl succinic acid, iso dodecenyl succinic acid, n-octyl succinic acid, n-oxotenyl succinic acid, and these acid anhydride or an acid chloride can be mentioned.

In particular as a preferable crystalline polyester compound, polyester obtained by reacting cyclohexane diol or 1,4-cyclohexanedimethanol with adipic acid, polyester obtained by reacting 1,6-hexanediol or 1,4-cyclohexane dimethanol with sebacic acid, polyester obtained by reacting ethylene glycol and succinic acid, polyester obtained by reacting ethylene glycol and sebacic acid, polyester obtained by reacting 1,4-butanediol and succinic acid can be mentioned. Among these, the polyester obtained by reacting cyclohexane diol, 1,4-cyclohexanedimethanol and adipic acid is particularly preferable.

As a containing ratio of the compound in the toner, it is preferable that crystalline polyester is from 1 to 30 percent by weight, and more preferably from 2 to 20 percent by weight, and in particular from 3 to 15 percent by weight of toner weight as a whole.

<Developers>

The toner of the present invention may be employed in either a single-component developer or a two-component developer.

Listed as single-component developers are a non-magnetic single-component developer, and a magnetic single-component developer in which magnetic particles having a diameter of 0.1 to 0.5 $\mu$m are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 $\mu$m, and is more preferably 25 to 80 $\mu$m.

The volume average particle diameter of said carrier can be generally determined employing a laser diffraction type particle diameter distribution measurement apparatus HELOS, produced by Japan Laser Corporation, which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited. For example, listed may be styrene-acryl based resins polyester resins, fluorine based resins, phenol resins, and the like.

The image forming apparatus employed in the image forming method using the toner of the invention is described.

Figure 3:
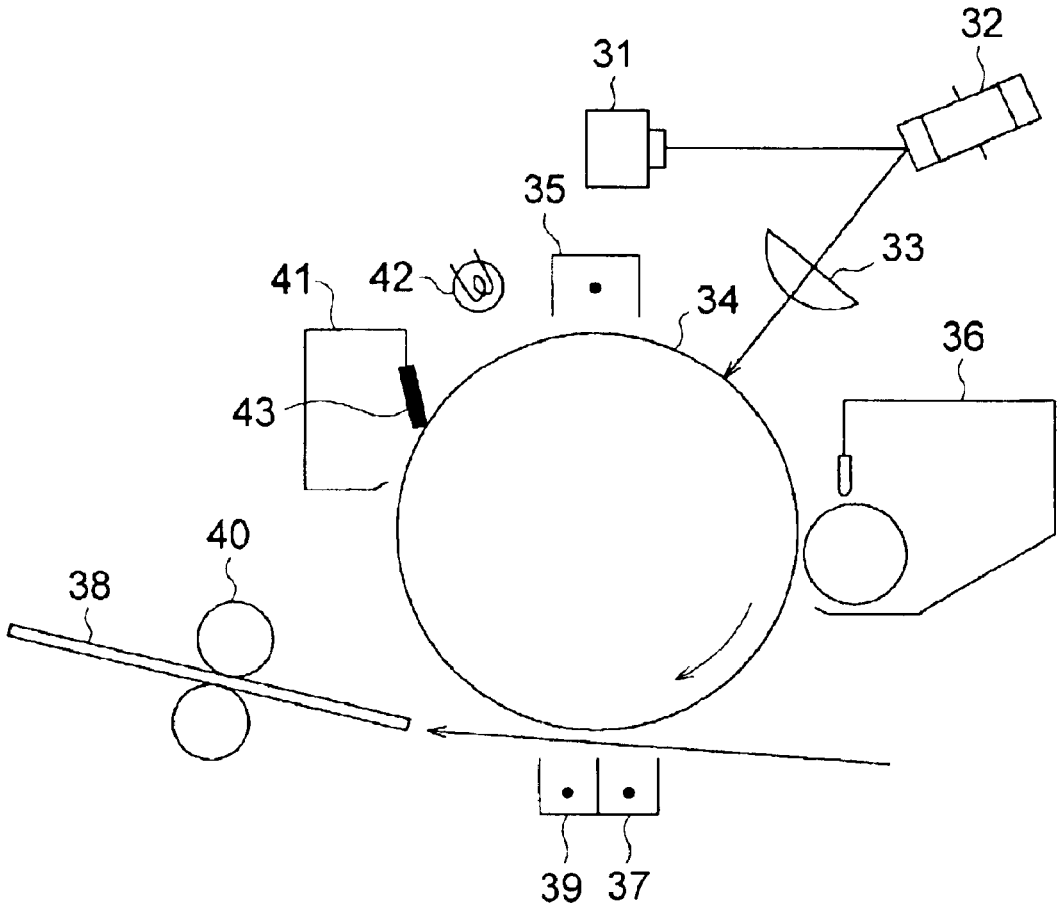
FIG. 3 shows an example of an image forming apparatus to which the present invention can be applied.

A cross-section of a color forming apparatus is shown in FIG. 3 as an example of the color forming apparatus for describing the image forming method according to the invention. In FIG. 3, numeral 34 shows a photoreceptor drum as a latent image carrier, which is constituted by coating OPC or organic photosensitive substance, on a substrate drum. The photoreceptor drum is grounded and driven so as to be clockwise rotated as is shown in the drawing.

Ozone content within the image forming apparatus is 0.1 to 10 ppm. The ozone content is measured by a gas detector having a detecting tube for air sampled between the charger 35 and developing device 36 shown in FIG. 3. Necessary volume of the air required by each detecting tube is sampled. A gas detector produced by Gastec Corporation is preferably employed. The ozone content can be measured by an ozone detecting method in accordance with the JIS other method than that employing the detecting tube.

Light exposure is emitted from laser diode source 31 according to the image information read in by reading means, not shown in FIG. 3. The light is scanned in a direction perpendicular to the paper plain by a rotating polygon mirror 32, and is exposed to the photoreceptor to form a latent image through an f$\theta$ lens 33, which compensate distortion of image. The photoreceptor drum 34 is charged uniformly by a charger 35 previously and starts rotation synchronized with the timing of the image exposure.

Developing device 36 develops the latent image on the photoreceptor, and the developed image is transferred to synchronously driven transferee paper 38 by transfer device 37. The transferee paper is separated from the photoreceptor by separating device (separating pole) 39, and the transferred image on the transferee paper is carried to fixing device to be fixed.

Remaining toner particles on the photoreceptor are swept by cleaning device 41. The residual charge on the photoreceptor is cancelled through precharging exposure light 42, and charger 35 again charges the photoreceptor uniformly.

The image light is exposed to the photoreceptor by preferably digital exposure and may be by analogue exposure.

Figure 4:
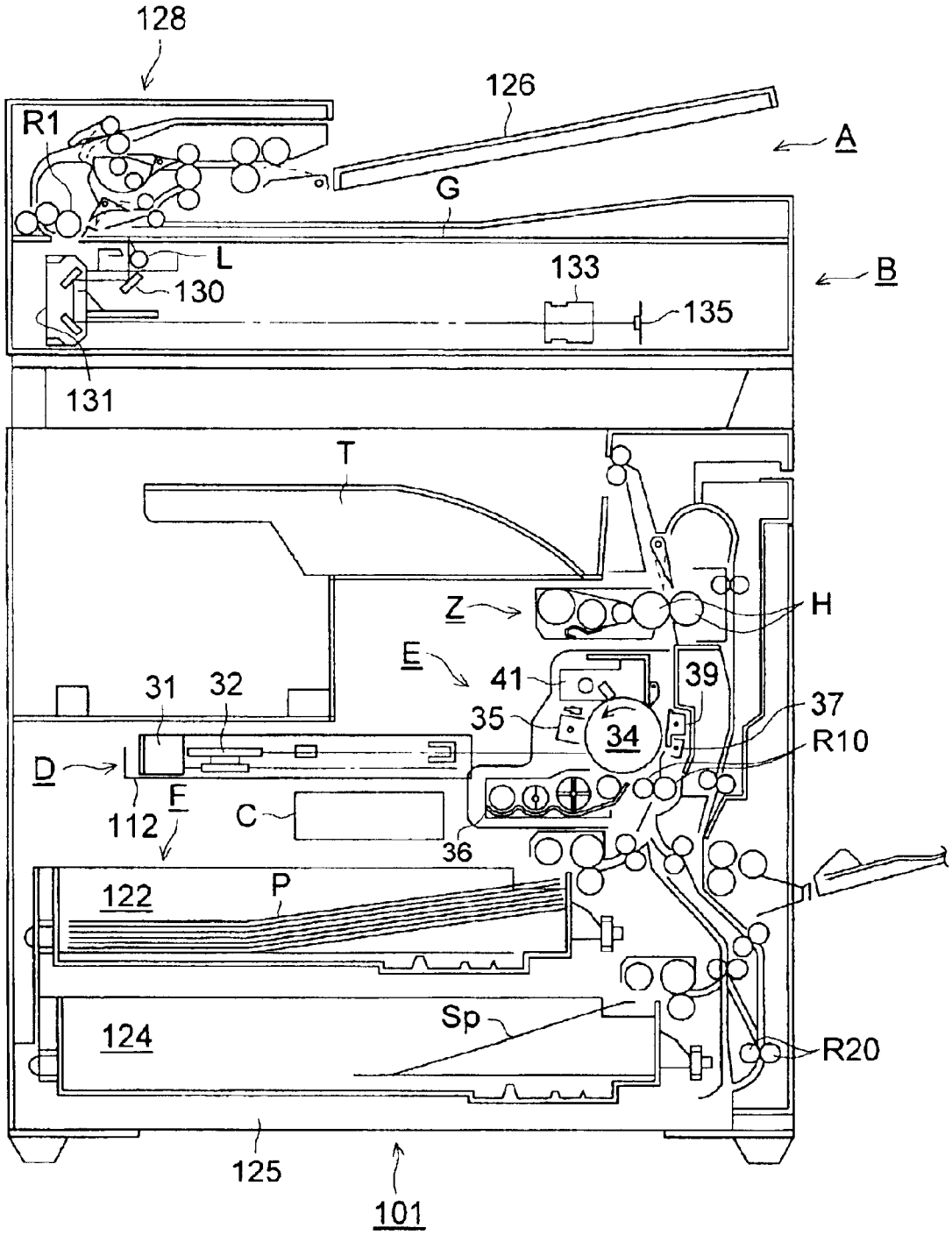
FIG. 4 shows an example of an image forming apparatus having digital exposing device to which the present invention can be applied.

The toner of the invention can be applied to an electrophotographic image forming apparatus, particularly, an apparatus in which a static latent image is formed on a photoreceptor by modulated beam of digital image data from computer. FIG. 4 shows a schematic view of an apparatus to which the present invention can be applied.

In FIG. 4, image forming apparatus 101 is composed of automatic document feeder (ADF) A, document image reader B for reading an image on a document conveyed by the automatic document feeder, image control unit C processing the read image data, exposure unit D containing the exposing device 112 that gives exposure, in accordance with data after image processing, to drum-shaped photoreceptor 34 representing an image carrier, image forming section E including photoreceptor 34, charger 35, developing device 36 composed of a developing device of a magnetic brush type, transfer device 37, separating device 39 and cleaning device 41, and so on provided around the photoreceptor, and a storing section F for sheet feeding trays 122 and 124 each storing recording sheet P.

The automatic document feeder A is composed mainly of document stand 126, document conveyance processing section 128 that includes a roller group including roller R1 and a switching means (having no symbols) for switching a path for movement of a document in case of need.

The document image reader B is located below platen glass G, and it is composed of two mirror units 130 and 131 capable of reciprocating by keeping an optical path length, fixed image forming lens (hereinafter referred to simply as a lens) 133 and linear image pick-up element (hereinafter referred to as CCD) 135. The exposure device D has therein laser light source 31, rotary polygon mirror 32 representing a polarizing means, and so on.

Numeral R1, shown at this side of transfer device 37 when viewed from the movement direction of recording sheet P, is a registration roller, and one shown with H at the downstream side of separation device 39 is a fixing device.

The fixing device H is composed of a roller having therein a built-in heating source and of a pressure-contact roller that rotates while being in pressure contact with the aforesaid roller.

Z represents a cleaning means for the fixing device H, and its main factor is a cleaning web that is provided to be capable of being taken up.

When a of documents (not shown) placed on the document stand 126 is passing below the roller R1 after being conveyed by the document conveyance processing section 128, the sheet is exposed by exposing means L.

Reflected light from a document passes through mirror units 130 and 131 located at fixed positions and through lens 133, and it is formed on CCD 135 as an image which is then read.

Image information, obtained through reading by the document image reader B, is processed to be image data which are stored in a memory of image control unit C.

The image data are read out of the memory in the case of image forming, and laser light source 31 in the exposure device D is driven in accordance with the aforesaid image data read out, and thereby, photoreceptor 34 is exposed to light.

In recent years, in the electrophotographic field wherein electrostatic latent images are formed on a photoreceptor and the resultant latent images are developed to prepare visible images, increasingly carried out has been research and development of the image forming method utilizing a digital system which makes it possible to easily carry out improvement in image quality, transformation, and edition, and to form high quality images.

As computers which are employed in said image forming method and apparatus thereof, or an optical scanning system which carries out light modulation based on digital image signals from copying original documents, included are a unit in which an acoustic optical modulator is provided via an optical laser system and light modulation is carried out employing said acoustic optical modulator, as well as a unit in which a semiconductor laser is employed and laser intensity is subjected to direct modulation. Spot exposure is carried out onto a uniformly charged photoreceptor from said optical scanning system whereby dot images are formed.

A beam irradiated from said optical scanning system results in a circular or elliptical luminance distribution near the normal distribution having a wide range at both sides. For example, a laser beam in either the primary direction or the secondary direction, or in both directions on the photoreceptor, generally results in extremely narrow circles or ellipses of 20 to 100 $\mu$m.

The invention can be applied to an apparatus for forming monochrome image as well as color image. The color image forming apparatus includes plural image forming units, each of which forms a color toner image different from each other to complete a color image.

The toner of the present invention is suitably applied to the image forming method comprising a process in which an image forming support, on which a toner image is formed, is passed between a heating roller and a pressing roller, constituting a fixing unit, so as to fix said image.

Figure 5:
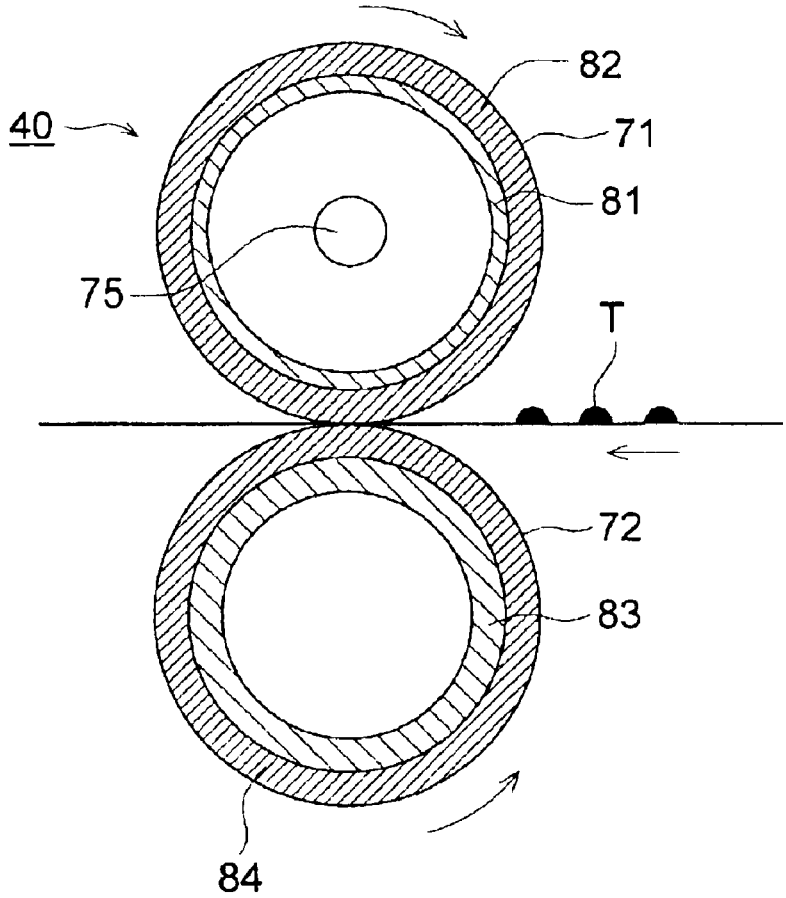
FIG. 5 shows a schematic view of a cross section of an example of fixing device which can be employed in the present invention.

FIG. 5 is a cross-sectional view showing one example of a fixing unit used in an image forming method employing the toner of the present invention. Fixing unit 40, shown in FIG. 5, is comprised of heating roller 71, and pressing roller 72 which comes into contact with said heating roller 71. Incidentally, in FIG. 5, T is a toner image formed on a transfer paper (being the image forming support).

Said heating roller 71 is prepared by forming cover layer 82 comprised of fluorine resins or an elastic body on the surface of metal pipe 81 and includes heating member 75 comprised of a linear heater in its interior.

Metal pipe 81 is comprised of metal, and its interior diameter is from 10 to 70 mm. Metals which comprise metal pipe 81 may include, for example, iron, aluminum, and copper, and alloys thereof.

The wall thickness of said metal pipe 81 is from 0.1 to 15 mm, and is determined taking into account the balance between the energy saving demand (a decrease in the wall thickness) and strength (being dependent on composition of the materials). For example, when the strength exhibited by a metal pipe comprised of iron with a wall thickness of 0.57 mm is intended to obtain employing a metal pipe comprised of aluminum, it is preferable to increase its wall thickness to 0.8 mm.

Exemplified as fluorine resins constituting covering layer 82 may be PTFE (polytetrafluoroethylene), PFA (tertafluoroethylene-perfluoroalkyl vinyl ether copolymers), and the like.

The thickness of covering layer made of fluorine resin is usually 10 to 500 $\mu$m, and is preferably 20 to 400 $\mu$m.

The elastic material forming a covering layer 82 includes silicone rubber or silicone sponge, which has good heat resistance, such as LTV, RTV and HTV.

An Asker C harness of the elastic material covering layer 82 is less than 80 degrees, preferably less than 80 degrees.

The thickness of the elastic material covering layer 82 is 0.1 to 30 mm, and preferably 0.1 to 20 mm.

Halogen heaters may be suitably employed as heating member 75.

Pressure roller 72 comprises cylinder 83 having on its surface covering layer 84 comprised of elastic materials. Elastic materials constituting covering layer are not particularly limited, and may include various types of soft rubber such as urethane rubber, silicone rubber, and the like, and also foamed rubber. Silicone rubber as well as silicone sponge rubber is preferably employed, which is exemplified as those constituting covering layer.

The Asker C hardness of elastic materials, constituting covering layer 84, is commonly less than 80 degrees, is preferably less than 70 degrees, and is more preferably less than 60 degrees.

Further, the thickness of covering layer 22 is commonly 0.1 to 30 mm, and is preferably 0.1 to 20 mm.

Materials constituting cylinder 83 include metals such as aluminum, iron, copper, and the like, and alloys thereof.

The contact load (total load) of heating roller 10 applied to pressure roller 72 is usually 40 to 350 N, is preferably 50 to 300 N, and is more preferably 50 to 250 N. Said load is set taking into the strength (the wall thickness of cylinder 81) of heating roller 10. For example, when a heating roller comprised of an iron cylinder having a wall thickness of 0.3 mm is employed, the applied load is preferably not more than 250 N.

Further, from the viewpoint of offsetting resistance as well as fixability, nip width is preferably 4 to 10 mm, and the surface pressure of said nip is preferably $0.6\times10^5$ to $1.5\times10^5$ Pa.

When the fixing unit shown in FIG. 3 is employed, an example of fixing conditions are as follows: fixing temperature (surface temperature of heating roller 10) is 150 to 210° C., and fixing linear speed is 80 to 640 mm/second.

The cleaning unit may be employed, being provided with a cleaning mechanism. Employed as cleaning systems are a system in which various types of silicone oils are supplied to fixing films, as well as a system in which cleaning is carried out employing a pad, a roller, or a web impregnated with various types of silicone oils.

Examples of silicone oils include polydimethylsiloxane, polyphenylsiloxane, or polydiphenylsiloxane. Further, siloxane containing fluorine may suitably be employed.

Methods for recycling toner are not particularly limited. For example, it is possible to cite a method in which toner recovered at a cleaning section is conveyed to a hopper for supply toner, or a development unit employing a transport conveyer or a transport screw, or is blended with a supply toner in an intermediate chamber and supplied to a development unit. As preferred methods, it is possible to list methods in which the recovered toner is directly returned to the development unit or the recovered toner is blended with the supply toner and then supplied to the development unit.

Figure 6:
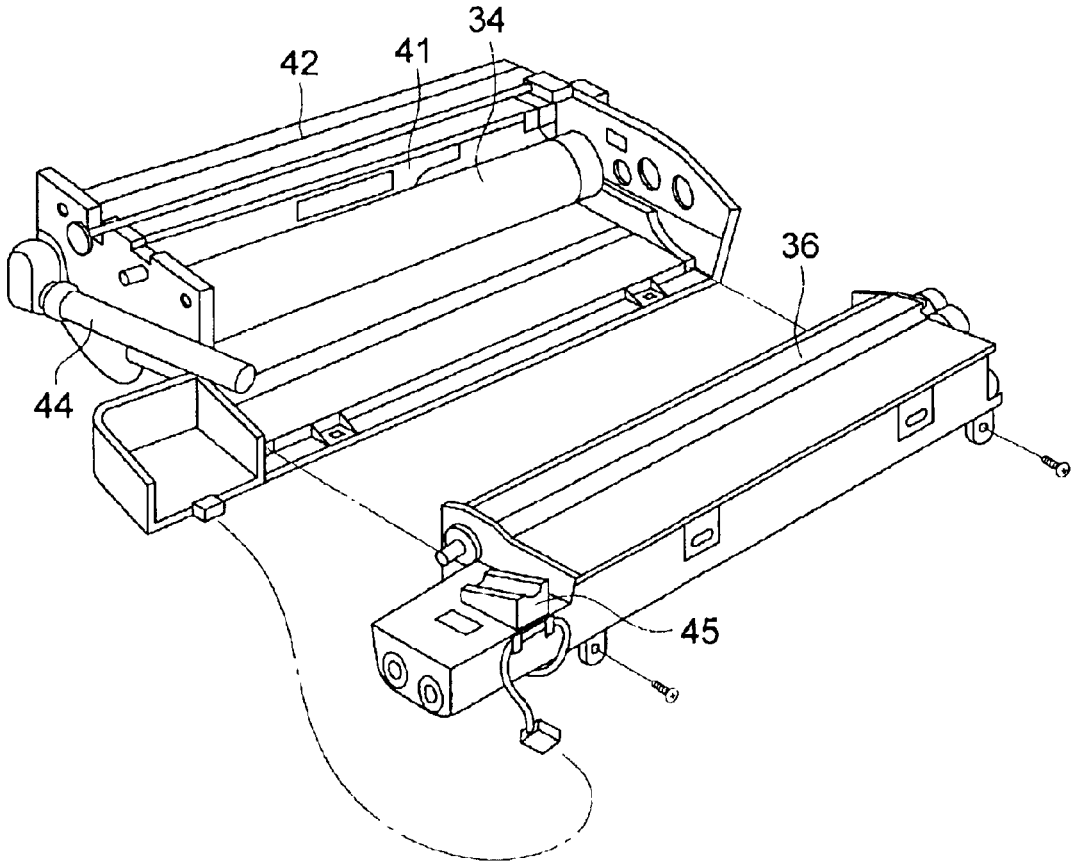
FIG. 6 shows a perspective view of an example of process cartridge having toner recycle system which can be employed in the present invention.

FIG. 6 is a perspective view of one example of the constitution of a toner recycling member. This method is one in which the recovered toner is returned directly to the development unit.

Non-transferred toner recovered by cleaning blade is collected and fed into toner recycling pipe 44, employing a transport screw 42 in toner cleaning unit 41; then returned to development unit 36 from inlet 45 of said recycling pipe; and again employed as developer.

FIG. 6 is also a perspective view of a detachable processing unit which is secured to the image forming apparatus of the present invention. In said FIG. 6, in order to clarify the perspective configuration, the photoreceptor unit is drawn separately from the developer unit. However, these may be integrated and detachably attached as a unit to the image forming apparatus. In this case, the photoreceptor, the development unit, the cleaning unit and the recycling members 42, 43 and 45 are integrated and comprised as the processing cartridge.

Further, said image forming apparatus may be structured so that a processing cartridge can be installed which comprises at least one of a photoreceptor drum, a charging unit, a development unit, a cleaning unit, or a recycling member.

Cleaning blade 13 is comprised of an elastic rubber body having a thickness of 1 to 30 mm. As such material, urethane rubber is most frequently employed. Since cleaning blade 13 is employed by being brought into pressure contact with the photoreceptor, it easily transmits heat. As a result, it is preferable to be withdrawn from the photoreceptor by providing a releasing mechanism while the image forming operation is not being performed.

Representative transfer paper includes plain paper. However, it is not particularly limited as long as unfixed images after development can be transferred, and includes a PET base for OHP.

EXAMPLES

The present inventing will now be detailed with reference to examples. The term "part(s)" denotes part(s) by weight.

Preparation of Resin Particles for Toner

Resin Particles 1HML (1) Preparation of Core Particle (a First Stage Polymerization)

Placed into a 5,000 ml separable flask fitted with a stirring unit, a temperature sensor, a cooling pipe, and a nitrogen gas inlet was a surface active agent solution (water based medium) prepared by dissolving 30.0 g of polyvinyl alcohol in 3,010 g of deionized water, and the interior temperature was raised to 80° C. under a nitrogen gas flow while stirring at 230 rpm.

Subsequently, a solution prepared by dissolving 9.2 g of a polymerization initiator (potassium persulfate, KPS) in 200 g of deionized water was added to the surface active agent solution and it was heated at 75° C., a monomer mixture solution consisting of 70.1 g of styrene, 19.9 g of n-butyl acrylate, and 10.9 g of methacrylic acid was added dropwise over 1 hour. The mixture underwent polymerization by stirring for 2 hours at 75° C. (a first stage polymerization). Thus resin particles (a dispersion comprised of higher molecular weight resin particles) were obtained. The resulting resin particles were designated as Resin particles (1H).

(2) Forming an Inter Layer (The Second Stage Polymerization)

A monomer solution was prepared in such way that 98.0 g of Exemplified Compound 19) was added to monomer mixture solution consisting of 105.6 g of styrene, 30.0 g of n-butyl acrylate, 6.2 g of methacrylic acid, 5.6 g of n-octyl-3-mercaptopropionic acid ester and the mixture was heated to 90° C. to dissolve the monomers in a flask equipped with a stirrer.

Surfactant solution containing 1.6 g of anionic surfactant sodium dodecylsulfonate dissolved in 2,700 ml of deionized water was heated to 98° C. To the surfactant solution 28 g (converted in solid content) the resin particles 1H, dispersion of core particles, was added, then the monomer solution containing the Exemplified Compound 19) was mixed and dispersed by means of a mechanical dispersion machine, "CLEARMIX" (produced by M Technique Ltd.) equipped with circulating pass for 8 hours, and a dispersion (emulsion) containing dispersion particles (oil droplet) was prepared.

Subsequently, initiator solution containing 5.1 g of polymerization initiator (KPS) dissolved in 240 ml of deionized water, and 750 ml of deionized water were added to the dispersion (emulsion). Polymerization was conducted by stirring with heating at 98° C. for 12 hours, as the result, resin particles (dispersion of composite resin particles which are composed of resin particles having higher molecular weight polymer resin covered with an intermediate molecular weight polymer) was obtained (a second stage polymerization). The resulting resin particles were designated as Resin particles (1HM).

(3) Forming Outer Layer (Third Stage Polymerization)

Polymerization initiator solution containing 7.4 g of polymerization initiator KPS dissolved in 200 ml deionized water was added to the resin particles 1HM, then monomer mixture solution consisting of 300 g of styrene, 95 g of n-butylacrylate, 15.3 g of methacrylic acid, and 10.4 g of n-octyl-3-mercaptoprpionic ester was added dropwise over 1 hour at temperature of 80° C. The mixture underwent polymerization by stirring with heating for 2 hours (a third stage polymerization), it was cooled to 28° C. Thus Resin particles 1HML composed of core composed of higher molecular weight polymer resin, an inter layer composed of an intermediate molecular weight polymer resin and an outer layer composed of lower molecular weight polymer resin in which inter layer the Exemplified Compound 19) was incorporated was obtained.

The polymers composed of composite resin particles composing the resin particles 1HML have peaks at molecular weight of 138,000, 80,000 and 13,000, and weight average particular size of the composite resin particles was 142 nm.

Resin Particles 2HML

Resin particles 2HML was prepared in the same manner as the preparation of 1HML except that 30 g of polyvinyl alcohol was modified to 54 g. Resin particles 2HML is a dispersion of composite resin particle having core part composed of high molecular weight resin, inter layer part composed of middle molecular weight resin and outer layer part composed of low molecular weight resin.

The polymers composed of composite resin particles composing the resin particles 2HML have peaks at molecular weight of 138,000, 78,000 and 11,000, and weight average particular size of the composite resin particles was 112 nm.

Resin Particles 3HML

Resin particles 3HML was prepared in the same manner as the preparation of 1HML except that 30 g of polyvinyl alcohol was modified to 22 g. Resin particles 3HML is a dispersion of composite resin particle having core part composed of high molecular weight resin, inter layer part composed of middle molecular weight resin and outer layer part composed of low molecular weight resin.

The polymers composed of composite resin particles composing the resin particles 3HML have peaks at molecular weight of 111,000, 54,000 and 17,000, and weight average particular size of the composite resin particles was 164 nm.

Resin Particles 4HML

Resin particles 4HML was prepared in the same manner as the preparation of 1HML except that 30 g of polyvinyl alcohol was replaced by 40 g of polyvinyl pyrrolidone. Resin particles 4HML is a dispersion of composite resin particle having core part composed of high molecular weight resin, inter layer part composed of middle molecular weight resin and outer layer part composed of low molecular weight resin.

The polymers composed of composite resin particles composing the resin particles 4HML have peaks at molecular weight of 171,000, 67,000 and 16,000, and weight average particular size of the composite resin particles was 127 nm.

Resin Particles 5HML

Resin particles 5HML was prepared in the same manner as the preparation of 1HML except that 30 g of polyvinyl alcohol was replaced by 20 g of polyvinyl pyrrolidone. Resin particles 5HML is a dispersion of composite resin particle having core part composed of high molecular weight resin, inter layer part composed of middle molecular weight resin and outer layer part composed of low molecular weight resin.

The polymers composed of composite resin particles composing the resin particles 5HML have peaks at molecular weight of 162,000, 82,000 and 18,000, and weight average particular size of the composite resin particles was 82 nm.

Comparative Resin Particles 1HML

Comparative Resin particles 1HML was prepared in the same manner as the preparation of 1HML except that 30 g of polyvinyl alcohol was replaced by 7.08 g of anionic surfactant sodium dodecyl benzenesulfonate. Comparative Resin particles 1HML is a dispersion of composite resin particle having core part composed of high molecular weight resin, inter layer part composed of middle molecular weight resin and outer layer part composed of low molecular weight resin.

The polymers composed of composite resin particles composing the Comparative Resin particles 1HML have peaks at molecular weight of 121,000, 74,000 and 15,000, and weight average particular size of the composite resin particles was 124 nm.

Comparative Resin Particles 2HML

Comparative Resin particles 1HML was prepared in the same manner as the preparation of 1HML except that 30 g of polyvinyl alcohol was replaced by 8.0 g of polyvinyl alcohol and 0.8 g of anionic surfactant sodium dodecyl benzenesulfonate. Comparative Resin particles 2HML is a dispersion of composite resin particle having core part composed of high molecular weight resin, inter layer part composed of middle molecular weight resin and outer layer part composed of low molecular weight resin.

The polymers composed of composite resin particles composing the Comparative Resin particles 2HML have peaks at molecular weight of 121,000, 74,000 and 15,000, and weight average particular size of the composite resin particles was 124 nm.

(Preparation Toners 1 to 5 and Comparative Toners 1 and 2)

Added to 1600 ml of deionized water were 59.0 g of anionic surfactant (101), which were stirred and dissolved. While stirring the resulting solution, 420.0 g of carbon black, "Regal 330" (produced by Cabot Corp.), were gradually added, and subsequently dispersed employing a stirring unit, "CLEARMIX" (produced by M Technique Ltd.). Colorant Dispersion 1 was obtained. Weight average weight particle diameter of the Colorant Dispersion 1 was 89 nm, measured by employing an electrophoresis light scattering photometer "ELS-800" (produced by Ohtsuka Electronics Co., Ltd.).

Placed into a four-necked flask fitted with a temperature sensor, a cooling pipe, a nitrogen gas inlet unit, and a stirring unit were 420.7 g (converted in solid content) of Resin particles (1HML), 900 g of deionized water, and 166 g of Black Colorant Dispersion Bk, and the resulting mixture was stirred. After adjusting the interior temperature to 30° C., 5N aqueous sodium hydroxide solution was added to the resulting solution, and the pH was adjusted to within the range from 8 to 10.0.

Subsequently, an aqueous solution prepared by dissolving 12.1 g of magnesium chloride tetrahydrate in 1,000 ml of deionized water was added at 30° C. over 10 minutes. After setting the resulting mixture aside for 3 minutes, it was heated so that the temperature was increased to 90° C. within the range from 6 to 60 minutes. While maintaining the resulting state, the diameter of coalesced particles was measured employing a "COULTER COUNTER TA-II". When the volume average particle diameter reached 2 to 7 μm, the growth of particles was terminated by the addition of an aqueous solution prepared by dissolving 80.4 g of sodium chloride in 1,000 ml of deionized water, and further fusion was continually carried out at a liquid media temperature of 85 to 98° C. for 12 hours, while being heated and stirred (digestion process).

Thereafter, the temperature was decreased to 30° C. Subsequently, the pH was adjusted to 2.0, and stirring was terminated. The resulting coalesced particles were collected through filtration, and washed with deionized water repeatedly. Washed particles were then dried by air at 40° C.

Added to each of Colored Particles and Cooperative Colored Particles were 0.8 part by weight of hydrophobic silica and 1.0 part by weight of hydrophobic titanium oxide, and the resulting mixture was mixed for 25 minutes while setting the peripheral velocity of the rotation blades of a 10-liter Henschel mixer at 30 m/second. Incidentally, it was confirmed that these colored particles exhibited no variation of shape and particle diameter by the addition of external additives.

The Toners 1–5 and Comparative Toners 1 and 2 having characteristics concerning particle size and shape as shown in Table 1, were obtained by controlling the dispersion property, by varying temperature, time and agitation strength of digestion process, and further by classification in liquid.

The toner samples were process by the following method to measure the characteristics as shown in Table 2. Each toner sample was dispersed in an epoxy resin, solidified and sliced by a microtome having a diamond blade. Each sliced sample was subjected to ozone plasma treatment by means of Plasma cleaner PC-2000, manufactured by South Bay Technology CO., Ltd. the RF output is set at 100 W, and a gas supplier having a gas flow meter and a needle valve supplies Ar and ozone gas. The treatment is performed for five minutes by supplying argon gas and for five minutes by supplying ozone gas, for ten minutes in total, under a vacuum condition formed by a vacuum pump of 96 l/min.

Treated sample was observed by a transmission electron-microscope. The shape of the area occupied by the colorant is visually confirmed on thus obtained photograph and the values specified by the invention are calculated by processing the image information by the use of image analyzing apparatus "LUZEX F", manufactured by Nireco Co., Ltd., attached to the electron-microscope.

TABLE 1

| Toner No. | Resin No. | Number Average Particle Diameter (in μm) | Ratio of Shape Factor of 1.2 to 1.6 (in %) | Variation Coefficient of Shape Factor (in %) | Ratio of Particles Having No Corners (in %) | Variation Coefficient of Number Distri-bution | Sum M of m1 and m2 (in %) |
|---|---|---|---|---|---|---|---|
| Toner 1 | 1 HML | 3.2 | 65.7 | 15.4 | 58 | 25.4 | 72.4 |
| Toner 2 | 2 HML | 4.8 | 68.4 | 15.8 | 55 | 25.8 | 73.4 |
| Toner 3 | 3 HML | 4.4 | 67.5 | 15.5 | 62 | 26.5 | 70.2 |
| Toner 4 | 4 HML | 4.2 | 66.4 | 14.4 | 52 | 26.5 | 71.2 |
| Toner 5 | 5 HML | 4.5 | 71.2 | 13.8 | 54 | 25.1 | 74.1 |
| Comparative Toner 1 | 1 HML | 4.8 | 72.3 | 14.5 | 62 | 23.7 | 70.6 |
| Comparative Toner 2 | 2 HML | 4.5 | 69.5 | 15.4 | 60 | 24.6 | 70.5 |

TABLE 2

| | Developer No. | Cell Structure after Plasma treatment | Cell Characteristics: Average FERE-horizontal diameter (in nm) | Cell Characteristics: Variation Coefficient of FERE-horizontal diameter (in %) | Cell Characteristics: Average of Shape Coefficient | Cell Characteristics: Variation Coefficient of Shape Coefficient | Ratio of Toner Particles Having cell wall |
|---|---|---|---|---|---|---|---|
| Example 1 | 1 | Observed | 126 | 16 | 128 | 17 | 97 |
| Example 2 | 2 | Observed | 82 | 12 | 122 | 11 | 89 |
| Example 3 | 3 | Observed | 147 | 24 | 137 | 19 | 82 |
| Example 4 | 4 | Observed | 105 | 32 | 156 | 28 | 64 |
| Example 5 | 5 | Observed | 64 | 8 | 108 | 5 | 84 |
| Comp. Example 1 | Comp. 1 | Not Observed | — | — | — | — | — |
| Comp. Example 2 | Comp. 2 | Observed | 220 | 38 | 162 | 32 | 21 |

Each of developers was installed in a digital copier (comprising corona charging, laser exposure, reversal development by non-magnetic single component developer, electrostatic transfer, claw separation, and a cleaning blade) having image forming processes described in FIG. 4, and subsequently evaluated. Evaluation was carried out while setting said digital copier at the following conditions. A gas detector having a detecting tube measured concentration between the charger and developing device. The ozone concentration was 5.5 ppm.

Charging Condition

Charging unit: scorotron charging unit. The initial charge potential was set at −750 V.

Exposure Condition

Exposure amount was set to result in an exposed area potential of −50 V.

Development Conditions

DC bias: −550 V

Transfer electrode: corona charging system

Further, the employed fixing unit comprised a heating roller having a surface roughness Ra of 0.8 μm, which was prepared by covering the surface of an iron cylinder with a 25 μm thick PFA (a tetrafluoroethylene-perfluoroalkyl vinyl ether copolymer) and a pressing roller having a surface roughness Ra of 0.8 μm, which was prepared by covering an iron cylinder with HTV silicone rubber which was further covered with a 120 μm thick PFA tube. Incidentally, its nip width was 3.8 mm and a linear rate was 420 mm/second.

Further, said cleaning unit was provided with neither a cleaning mechanism nor a silicone oil supplying mechanism. Fixing temperature was controlled employing said heating roller and set at 165° C.

As copying conditions, 900,000 copies were continuously prepared at low temperature and low humidity (10° C. and 20 percent relative humidity). The amount of fine toner particles, the fog value, number of sheets in which toner scattering was observed, the number of sheet in which toner fusing on the developer roller was observed, the cleaning properties, and fixing characteristics were evaluated by the following criteria.

Fine Toner Particles

Toner on the developing roller was taken and percentage by number of fine toner particles having particle size of not more than 1 μm by Coulter Multisizer with an aperture of 1 μm was counted for the first print and 200,000th print.

Fog

Image density at the non-image portion was measured relative to non-printing sheet by Macbeth Densitometer.

Toner Scattering

The number of sheet in which transfer defect due to the scattered toner accumulated on the transfer device was found on a half-tone image at first was counted.

Cleaning Deficiency

The number of sheet in which stain due to toner passed through the cleaning device was found at first was counted.

Toner Fusion on the Developer Roll

The number of sheet in which streaks stain of half-tone image due to fused toner on the developing roller was found at first in every 10,000 printing was observed.

Fixing Performance

Fixed images were prepared while varying the temperature of the heated roll from 130 to 240° C. at increments of 10° C. Plain paper of "A-size" having basic weight of 64 g/m$^2$ was employed for printing.

The fixing strength of obtained fixed images was evaluated employing a fixing ratio obtained by a method in accordance with a mending tape peeling method described in Chapter 1, Item 1.4 of "Denshishasin Gijutsu no Kiso to Oyo (Fundamentals and Application of Electrophotographic Technology, edited by Denshishasin Gakkai (Electrophotographic Society)". The density of images was measured employing a Macbeth Reflection Densitometer RD-918. The fixing temperature, at which 90 percent of the fixing ratio was obtained, was designated as a fixable temperature.

The performance of each toner was classified into 5 levels based on the evaluation of each fixable temperature.

Rank Fixable Temperature

A: Not less than 100° C. (Excellent)

B: Not less than 70 to 100° C. (Good)

C: Not less than 40 to 70° C. (Acceptable)

D: Less than 40 (Unacceptable)

The result is summarized in Table 3.

TABLE 3

| | Fine Toner Particles | | Fog | | | | | |
|---|---|---|---|---|---|---|---|---|
| | First Print | 200,000th Print | First Print | 200,000th Print | Toner Scattering | Cleaning Deficiency | Toner Fusion | Fixing Performance |
| Example 1 | 6.2 | 7.2 | 0.001 | 0.002 | 320,000th | 540,000th | Not found up to 900,000th sheet | A |
| Example 2 | 6.9 | 8.4 | 0.001 | 0.002 | 280,000th | 490,000th | 800,000th | B |
| Example 3 | 7.1 | 8.7 | 0.002 | 0.002 | 260,000th | 450,000th | 800,000th | B |
| Example 4 | 6.7 | 9.6 | 0.002 | 0.004 | 240,000th | 380,000th | 600,000th | C |
| Example 5 | 6.4 | 9.8 | 0.001 | 0.003 | 220,000th | 350,000th | 600,000th | C |
| Comp. Example 1 | 6.5 | 26.4 | 0.001 | 0.018 | 40,000th | 40,000th | 100,000th | D |
| Comp. Example 2 | 6.9 | 24.5 | 0.001 | 0.012 | 50,000th | 30,000th | 100,000th | D |

As can clearly be seen from the examples, by employing Examples 1 through 5 according to the present invention, it was confirmed that images, which exhibited fine toner particles having less than 1 mm particle size, fog, toner scattering, toner fusing on the developing roller, cleaning deficiency as well fixing characteristics, were obtained. Contrary to the inventive sample, the comparative samples 1 and 2 do not exhibit such efficiencies.

A toner having sufficient ozone resistively, which is not deteriorated and not powdered in an atmosphere containing ozone, is provided. As the result, problems stain of charging device, stain of the photoreceptor, cleaning deficiency and so on are dissolved.

What is claimed is:

1. A toner for developing a static charged image containing a toner particle comprising a resin and a colorant, wherein the resin has a cell structure having cells and a cell wall, and an average value of FERE-horizontal diameters of the cells is from 20 to 200 nm and a variation coefficient of the FERE-horizontal diameters of the cells is from 10 to 35%.

2. The toner of claim 1, wherein the average value of the FERE-horizontal diameters is from 120 to 160 nm and the variation coefficient is not more than 30%.

3. The toner of claim 1, wherein the toner particle further contains a crystalline substance.

4. The toner of claim 1, wherein the colorant particles are distributed between the cells.

5. The toner of claim 1, wherein the toner particle comprises the resin, the colorant and the crystalline substance and the colorant particles are distributed between the cells.

6. The toner of claim 1, wherein the toner particle comprises the resin, the colorant and the crystalline substance and the crystalline substance is distributed between the cells.

7. The toner of claim 1, wherein the number variation coefficient in the number size distribution is not more than 27 percent and the variation coefficient of said shape coefficient is not more than 16 percent.

8. The electrostatic image developing toner of claim 1, wherein the ratio of toner particles without corners is at least 50 percent by number and the number variation coefficient in the number particle size distribution is 27 percent or less.

9. The electrostatic image developing of claim 1, wherein the ratio of toner particles, having a shape factor in the range of 1.2 to 1.6, is at least 65 percent by number, and the number variation coefficient in the number particle size distribution is 27 percent or less.

10. The electrostatic image developing of claim 1, wherein sum M of relative frequency m1 and m2 of toner particles is at least 70 percent, which is included in the most frequent class in the histogram which shows the particle size distribution based on the number of particles which is drawn in such a manner that regarding said toner, when the particle diameter of toner particles is represented by D in $\mu$m, natural logarithm in D is taken as the abscissa, and said abscissa is divided into a plurality of classes at an interval of 0.23.

11. The electrostatic image developing toner of claim 1, wherein said toner has a number average particle diameter of 2 to 7 $\mu$m.

12. The electrostatic image developing toner of claim 1, wherein said toner is prepared by polymerizing at least a polymerizable monomer in a water-based medium.

13. The electrostatic image developing toner of claim 1, wherein said toner is prepared by aggregating and fusing at least resinous particles in a water-based medium.

14. The electrostatic image developing toner of claim 1, wherein said toner is prepared by salting out/fusing colorant particles and fine composite resinous particles which have been formed through a process to polymerize a polymerizable monomer after dissolving a crystalline material in at least said polymerizable monomer.

15. The electrostatic image developing of claim 1, wherein said toner is prepared by salting out/fusing colorant particles and fine composite resinous particles prepared by a multi-step polymerization method.

16. The electrostatic image developing of claim 1, wherein said toner is prepared by forming a resinous layer which is prepared by fusing resinous particles employing a salting-out/fusion method on resinous and colored particles.

17. A method of forming a toner image, comprising:

electrically charging a photoreceptor;

imagewise exposing the photoreceptor so that a latent image is formed on the photoreceptor;

developing the latent image with toner so that a toner image is formed on the photoreceptor;

wherein the imagewise exposing is carried out by digital exposure, and the developing is carried out by employing toner of claim 1.

18. The method of claim 17, wherein the toner is repeatedly used by recycling.

19. The method of claim 17, wherein the developing is carried out in a circumference where the ozone concentration in the atmosphere of the developing means is from 0.1 to 10 ppm.

20. An image forming apparatus, comprising:

a photoreceptor;

a charging device to electrically charging the photoreceptor;

an exposing device to imagewise exposing the photoreceptor so that a latent image is formed on the photoreceptor;

a developing device to develop the latent image with toner so that a toner image is formed on the photoreceptor;

wherein the exposing to the photoreceptor is carried out by digital exposure.

21. An image forming apparatus of claim 20, which further comprises a means for recycling the toner.

* * * * *